US010441101B2

(12) United States Patent
Wilson et al.

(10) Patent No.: US 10,441,101 B2
(45) Date of Patent: Oct. 15, 2019

(54) THREE DOOR LID AND CONTAINER UTILIZING THE SAME

(71) Applicant: MCCORMICK & COMPANY, INCORPORATED, Sparks, MD (US)

(72) Inventors: Tracie L. C. Wilson, Westminster, MD (US); Thomas Koll Porter Gieske, Lutherville, MD (US); Darin Pugne, Carnegie, PA (US); Adam Beaty, Lebanon, TN (US); Don Ankney, Stanford, KY (US); Ron Myers, Jackson, TN (US); Charles A. Webster, Belmont, OH (US); Stephen B. Getsy, Bridgeville, PA (US); Dewey Carlile, Belmont, OH (US)

(73) Assignee: MCCORMICK & COMPANY, INCORPORATED, Hunt Valley, MD (US)

( * ) Notice: Subject to any disclaimer, the term of this patent is extended or adjusted under 35 U.S.C. 154(b) by 0 days.

(21) Appl. No.: 15/707,573

(22) Filed: Sep. 18, 2017

(65) Prior Publication Data

US 2018/0092478 A1 Apr. 5, 2018

Related U.S. Application Data

(60) Provisional application No. 62/396,578, filed on Sep. 19, 2016.

(51) Int. Cl.
*A47G 19/24* (2006.01)
*B65D 25/20* (2006.01)
(Continued)

(52) U.S. Cl.
CPC ..... *A47G 19/24* (2013.01); *B65D 25/205* (2013.01); *B65D 43/161* (2013.01); *B65D 43/169* (2013.01); *B65D 47/0847* (2013.01); *B65D 51/247* (2013.01); *B65D 83/06* (2013.01); *B65D 2101/00* (2013.01); *B65D 2203/02* (2013.01); *B65D 2255/06* (2013.01); *B65D 2543/00537* (2013.01)

(58) Field of Classification Search
CPC ..... B65D 21/0217
USPC ..... 220/324, 315, 834, 833, 810, 254.2, 220/254.1, 803, 804, 802, 801, 796; 206/508, 509
See application file for complete search history.

(56) References Cited

U.S. PATENT DOCUMENTS 844,640 A 2/1907 West
961,991 A 6/1910 Ullrich
(Continued)

*Primary Examiner* — Robert J Hicks
*Assistant Examiner* — Matusala K Tewolde
(74) *Attorney, Agent, or Firm* — Greenblum & Bernstein, P.L.C.

(57) ABSTRACT

Container having a container body comprising a bottom, a rim and a lid securing portion located adjacent the rim. A lid includes a lid base sized and configured to secure the lid to the lid securing portion of the container body and a lid door assembly movably mounted to the lid base. The lid door assembly includes a main door that can assume at least a closed position with respect to the lid base and an open position with respect to the lid base, a first side door that can assume at least a closed position with respect to the main door and an open position with respect to the main door, and a second side door that can assume at least a closed position with respect to the main door and an open position with respect to the main door.

19 Claims, 58 Drawing Sheets

(51) Int. Cl.

| | |
|---|---|
| ***B65D 43/16*** | (2006.01) |
| ***B65D 47/08*** | (2006.01) |
| ***B65D 83/06*** | (2006.01) |
| ***B65D 51/24*** | (2006.01) |

(56) References Cited

U.S. PATENT DOCUMENTS

| | | | | |
|---|---|---|---|---|
| 1,134,427 | A | 4/1915 | Ullrich | |
| 1,141,535 | A | 6/1915 | Freundt | |
| 1,184,549 | A | 5/1916 | McClung | |
| 1,295,997 | A | 3/1919 | Mennen | |
| 1,658,348 | A | 2/1928 | Leonard | |
| 1,767,781 | A | 6/1930 | Aubach | |
| 1,803,799 | A | 5/1931 | Charles | |
| 1,894,575 | A | 1/1933 | Sherman | |
| 1,959,874 | A | 5/1934 | Mills | |
| 2,045,855 | A | 6/1936 | Hovey | |
| 2,046,929 | A | 7/1936 | Charles | |
| 2,108,045 | A | 2/1938 | Dirker | |
| 2,162,999 | A | 6/1939 | Emil | |
| 2,167,574 | A | 7/1939 | Lee | |
| 2,190,676 | A | 2/1940 | Perry | |
| 2,235,987 | A | 3/1941 | Emil | |
| 2,241,435 | A | 5/1941 | White | |
| 2,273,998 | A | 2/1942 | Rueger | |
| 2,273,999 | A | 2/1942 | Rueger | |
| 2,283,245 | A | 5/1942 | White | |
| 2,287,747 | A | 6/1942 | Frank | |
| 2,310,271 | A | 2/1943 | Ziehmer | |
| 2,324,499 | A | 7/1943 | Erb | |
| 2,346,847 | A | 4/1944 | Larson | |
| 2,878,971 | A | 3/1959 | Malachick | |
| 3,127,052 | A | 3/1964 | Mayers | |
| 3,129,860 | A | 4/1964 | Foster | |
| 3,155,285 | A | 11/1964 | Baarn | |
| 3,169,671 | A | 2/1965 | Edward | |
| 3,187,964 | A | 6/1965 | Foster | |
| D204,509 | S | 4/1966 | Waterman | |
| 3,251,509 | A | 5/1966 | Foster | |
| 3,255,928 | A | 6/1966 | Foster | |
| 3,370,757 | A | 2/1968 | Foster | |
| 3,397,823 | A | 8/1968 | Kirkpatrick | |
| 3,542,235 | A | 11/1970 | Hidding | |
| 3,589,572 | A | 6/1971 | Hannon | |
| 3,737,066 | A | 6/1973 | Ames | |
| 3,817,420 | A | 6/1974 | Heisler | |
| 3,872,996 | A | 3/1975 | Dogliotti | |
| 4,144,985 | A | 3/1979 | Kinslow | |
| 4,253,587 | A | 3/1981 | Otterson | |
| 4,280,636 | A | 7/1981 | Lewis | |
| 4,359,171 | A | 11/1982 | Lewis | |
| 4,369,901 | A | 1/1983 | Hidding | |
| 4,463,869 | A | 8/1984 | Lewis | |
| 4,471,881 | A | 9/1984 | Foster | |
| 4,494,679 | A | 1/1985 | Cleevely | |
| D278,675 | S | 5/1985 | Tardif | |
| 4,526,291 | A | 7/1985 | Margulies | |
| 4,592,480 | A | 6/1986 | Hart | |
| 4,610,371 | A | 9/1986 | Karkiewicz | |
| 4,621,744 | A | 11/1986 | Foster | |
| 4,634,019 | A | 1/1987 | Pherigo | |
| 4,658,980 | A | 4/1987 | Lindstrom | |
| 4,723,693 | A | 2/1988 | Decoster | |
| 4,724,977 | A | 2/1988 | Cleevely | |
| 4,724,979 | A | 2/1988 | Cleevely | |
| D301,549 | S | 6/1989 | Foster | |
| 4,934,554 | A | 6/1990 | Edwards | |
| 4,934,557 | A | 6/1990 | Smith | |
| 5,002,197 | A | 3/1991 | Ponsi | |
| 5,085,331 | A | 2/1992 | Groya | |
| 5,103,989 | A | 4/1992 | Druesne | |
| 5,123,561 | A | 6/1992 | Gross | |
| 5,145,088 | A | 9/1992 | Goujon | |
| 5,195,645 | A | 3/1993 | Schuermann | |
| 5,211,301 | A | 5/1993 | Groya | |
| 5,219,087 | A | 6/1993 | Christensson | |
| 5,219,100 | A | 6/1993 | Beck | |
| 5,301,827 | A | 4/1994 | Valyi | |
| 5,303,839 | A | 4/1994 | Blumenschein | |
| 5,307,948 | A | 5/1994 | Blackburn | |
| 5,353,946 | A | 10/1994 | Behrend | |
| 5,482,172 | A | 1/1996 | Braddock | |
| 5,636,732 | A | 6/1997 | Gilels | |
| 5,730,785 | A | 3/1998 | Idol et al. | |
| 5,897,036 | A | 4/1999 | Decoster | |
| 6,068,153 | A | 5/2000 | Young | |
| 6,196,412 | B1 | 3/2001 | Cattell | |
| D442,086 | S | 5/2001 | Mozes | |
| D446,722 | S | 8/2001 | Morrow | |
| 6,341,720 | B1 | 1/2002 | Schmit | |
| D456,713 | S | 5/2002 | Bried | |
| 6,422,411 | B1 * | 7/2002 | Gray | B65D 21/022 220/214 |
| D470,765 | S | 2/2003 | Baker | |
| D473,792 | S | 4/2003 | Diefenbach | |
| D474,402 | S | 5/2003 | Baerenwald | |
| 6,561,391 | B1 | 5/2003 | Baker | |
| 6,575,323 | B1 | 6/2003 | Martin | |
| D491,065 | S | 6/2004 | Solowiejko | |
| D492,200 | S | 6/2004 | Solowiejko | |
| D494,469 | S | 8/2004 | Solowiejko | |
| D494,812 | S | 8/2004 | Tremblay | |
| D495,256 | S | 8/2004 | Solowiejko | |
| D497,106 | S | 10/2004 | Solowiejko | |
| 6,877,631 | B1 | 4/2005 | Thompson | |
| 6,899,245 | B1 | 5/2005 | Nelson | |
| 7,021,482 | B2 | 4/2006 | Solowiejko | |
| D530,606 | S | 10/2006 | Liebe | |
| 7,114,627 | B2 | 10/2006 | Solowiejko | |
| D538,664 | S | 3/2007 | Solowiejko | |
| D539,647 | S | 4/2007 | Solowiejko | |
| D544,309 | S | 6/2007 | Gutekunst | |
| 7,258,255 | B2 | 8/2007 | Vogel | |
| D557,979 | S | 12/2007 | Charriez | |
| D567,582 | S | 4/2008 | Blum | |
| D592,966 | S | 5/2009 | Nissen | |
| D599,203 | S | 9/2009 | Wilson | |
| D604,161 | S | 11/2009 | Wilson | |
| D615,862 | S | 5/2010 | Wilson | |
| 8,113,377 | B2 | 2/2012 | Solowiejko | |
| 8,286,817 | B2 * | 10/2012 | Wilson | B65D 47/0828 220/254.2 |
| 8,464,886 | B2 | 6/2013 | Fisher | |
| 8,550,313 | B2 * | 10/2013 | Daggett | B65D 43/161 215/235 |
| 8,793,968 | B2 | 8/2014 | Cronin | |
| 2001/0011649 | A1 | 8/2001 | Fujie | |
| 2001/0035424 | A1 | 11/2001 | Combe | |
| 2002/0009524 | A1 | 1/2002 | Deering | |
| 2004/0079757 | A1 | 4/2004 | Ciccone | |
| 2004/0079765 | A1 | 4/2004 | Gallo | |
| 2005/0040168 | A1 | 2/2005 | Solowiejko | |
| 2005/0145628 | A1 | 7/2005 | Schwarz | |
| 2006/0144874 | A1 | 7/2006 | Solowiejko | |
| 2007/0000887 | A1 | 1/2007 | Caldwell | |
| 2007/0000953 | A1 | 1/2007 | Ranney | |
| 2007/0056972 | A1 * | 3/2007 | Solowiejko | B65D 21/022 220/254.2 |
| 2007/0131639 | A1 | 6/2007 | Nakaya | |
| 2007/0170192 | A1 * | 7/2007 | Blum | B65D 47/0838 220/826 |
| 2009/0101645 | A1 | 4/2009 | Wilson | |
| 2009/0101647 | A1 | 4/2009 | Newberry | |
| 2009/0101674 | A1 | 4/2009 | Newberry | |
| 2010/0084399 | A1 | 4/2010 | Shieh | |
| 2011/0139783 | A1 | 6/2011 | Fisher | |
| 2011/0192847 | A1 | 8/2011 | Vandamme | |
| 2011/0239597 | A1 | 10/2011 | Wilson | |
| 2013/0186897 | A1 * | 7/2013 | Luburic | B65D 21/0222 220/265 |

* cited by examiner

THREE DOOR LID AND CONTAINER UTILIZING THE SAME

CROSS-REFERENCE TO RELATED APPLICATIONS

The instant application is a US non-provisional Application claiming the benefit of U.S. provisional application No. 62/396,578 filed on Sep. 19, 2016, the disclosure of which is hereby expressly incorporated by reference thereto in its entirety.

BACKGROUND OF THE INVENTION

1. Field of the Invention

This invention relates generally to containers and lids and especially dry food or granulated product containers such as, e.g., spice or pepper containers, and well as a method of making and using the same.

2. Discussion of Background Information

U.S. 2007/0170192 to Blum et al, the disclosure of which is hereby expressly incorporated by reference in its entirely, discloses various embodiments of a container having a three-door lid.

However, existing or known dry food containers lack one or more features utilized in the container or lid or combination disclosed herein.

SUMMARY OF THE INVENTION

According to one non-limiting embodiment of the invention, there is provided a container comprising a container body comprising a bottom, a rim and a lid securing portion located adjacent the rim. A lid comprises a lid base sized and configured to secure the lid to the lid securing portion of the container body and a lid door assembly movably mounted to the lid base. The lid door assembly comprises a main door that can assume at least a closed position with respect to the lid base and an open position with respect to the lid base, a first side door that can assume at least a closed position with respect to the main door and an open position with respect to the main door, and a second side door that can assume at least a closed position with respect to the main door and an open position with respect to the main door.

In embodiments, the container is sized to contain a granular food.

In embodiments, the main door allows for contents of the container to be spooned out when in the open position.

In embodiments, the first door allows for contents of the container to be poured out when in the open position.

In embodiments, the second door allows for contents of the container to be sifted out when in the open position.

In embodiments, the main door has a larger cross-sectional area than the rim of the container body.

In embodiments, the main door comprises a sealing bead that engages with the rim of the container body when in the closed position.

In embodiments, the main door has a larger cross-sectional area than either the first door or the second door.

In embodiments, the main door is connected to the lid base via a hinge.

In embodiments, the first door overlies and closes a pouring opening formed in the main door when in the closed position.

In embodiments, the pouring opening is generally triangular.

In embodiments, the first door comprises a sealing bead that engages with a pouring opening formed in the main door when in the closed position.

In embodiments, the first door comprises a stacking bead.

In embodiments, the first door is mounted via a hinge.

In embodiments, the second door overlies and closes plural sifting openings formed in the main door when in the closed position.

In embodiments, the plural sifting openings are generally circular.

In embodiments, the second door comprises at least one sealing projection that engages with one of the plural siding openings formed in the main door when in the closed position.

In embodiments, the first door comprises a stacking bead.

In embodiments, the second door comprises a stacking bead.

In embodiments, the first door is mounted via a hinge.

In embodiments, the second door is mounted via a hinge.

In embodiments, the main door is retained in the closed position by a snap connection disposed opposite a hinge connecting the main door to the lid base.

In embodiments, the first door is mounted via a hinge oriented generally perpendicular to the hinge of the main door.

In embodiments, the second door is mounted via a hinge oriented generally perpendicular to the hinge of the main door.

In embodiments, the first door is retained in the closed position by a snap connection and is mounted via a hinge to one portion of the main door.

In embodiments, the first door is retained in the closed position by a snap connection and is mounted via a hinge to another portion of the main door.

In embodiments, the first door is connected via a hinge to a connecting section non-removably coupled to the main door.

In embodiments, the second door is connected via a hinge to a connecting section non-removably coupled to the main door.

In embodiments, a connecting section is non-removable connected to the main door, the first door is connected via a hinge to a first side of the connecting section and the second door is connected via a hinge to a second side of connecting section.

In embodiments, the lid base is connected to the lid securing portion so that removal of the lid base requires greater force than opening the main door.

In embodiments, a force required to open either of the first and second doors is less than that required to open the main door.

In embodiments, the lid base and the main door are an integrally formed member connected by a living hinge.

In embodiments, the first and second doors are arranged on an integrally formed member having a central section that is connectable to the main door.

In embodiments, the first and second doors are each connected to the central section by a living hinge.

In embodiments, the lid securing section comprises a chamfered zone arranged above an indented zone.

In embodiments, the container body further comprises a chamfer located adjacent the bottom of the container body.

In embodiments, the container further comprises a removable or peelable tamper-proof seal connected to the rim of the container body. Alternatively or additionally, a full body shrink sleeve can be utilized to provide assurance to a user or purchaser that the product container has not yet been used or tampered with.

In embodiments, the lid is made of a first synthetic resin material and the container body is made of a second synthetic resin material.

In embodiments, the invention also provides for a container comprising a container body comprising a generally rectangular cross-section, a generally rectangular bottom, a generally rectangular rim and a lid securing portion located adjacent the rim. A generally rectangular lid comprises a lid base sized and configured to secure the lid to the lid securing portion of the container body and a lid door assembly movably mounted to the lid base. The lid door assembly comprises a main door that can assume at least a closed position with respect to the lid base and an open position with respect to the lid base, a first side door that can assume at least a closed position with respect to the main door and an open position with respect to the main door, and a second side door that can assume at least a closed position with respect to the main door and an open position with respect to the main door.

In embodiments, the invention also provides for a spice container comprising a container body comprising a generally rectangular cross-section having a width that is greater than a depth, a generally rectangular bottom, a generally rectangular rim, a lid securing portion located adjacent the rim, and a height that is greater than the width. A generally rectangular lid comprises a lid base sized and configured to secure the lid to the lid securing portion of the container body, such that when installed, an upper end of the lid base is disposed at or below an upper end of the rim. A lid door assembly comprises a main door connected to the lid base via a hinge and that can assume at least a closed position with respect to the lid base and an open position with respect to the lid base, a first side door connected to a first hinge and that can assume at least a closed position with respect to the main door and an open position with respect to the main door, and a second side door connected to a second hinge and that can assume at least a closed position with respect to the main door and an open position with respect to the main door.

In embodiments, the invention also provides for a spice container comprising a container body comprising a generally rectangular cross-section having a width that is greater than a depth, a generally rectangular bottom, a generally rectangular rim, a lid securing portion located adjacent the rim and comprising a chamfered region and an indented region and a height that is greater than the width. A generally rectangular lid comprises a lid base sized and configured to secure the lid to the lid securing portion of the container body, such that when installed, an upper end of the lid base is disposed at or below an upper end of the rim. A lid door assembly comprises a main door section connected to the lid base via a main hinge, a connecting section non-removably secured to the main door section, a first side door connected to the connecting section via a first hinge, and a second side door connected to the connecting section via a second hinge. The first and second hinges are oriented generally parallel to one another and generally perpendicular to the main hinge.

In embodiments, the invention also provides for a spice container comprising a sidewall having a generally rectangular cross-section having a width that is greater than a depth, a generally rectangular bottom, a generally rectangular rim having a rim flange that projects inwards so as to define a generally horizontal sealing surface, a lid securing portion located adjacent the rim and comprising a chamfered region and an indented region, and a bottom chamfer arranged where the sidewall meets the bottom.

In embodiments, the rim flange is angled upward relative to an imaginary horizontal plane.

In embodiments, the rim flange is angled upward by about 5 degrees relative to an imaginary horizontal plane.

In embodiments, the rim flange has a width of between 1/16 and 1/4 inches.

In embodiments, the rim flange has a width of approximately 1/8 inch.

In embodiments, the rim flange extends from an upper end of the chamfered region.

In embodiments, an edge of the rim flange defines a generally rectangular cross-section having a width that is greater than a depth.

In embodiments, the chamfered region has an angle greater than 45 degrees relative to an imaginary horizontal plane.

In embodiments, the bottom chamfer has an angle greater than 45 degrees relative to an imaginary horizontal plane.

In embodiments, a volume of the spice container is one of about 2 ounces, about 3 ounces, about 4 ounces, about 5 ounces, about 6 ounces, between 2 and 12 ounces, between 1 and 16 ounces, and between 1 and 32 ounces.

In embodiments, the sidewall is generally transparent.

In embodiments, there is provided a spice container comprising a sidewall having a generally rectangular cross-section having a width that is greater than a depth and a height that is greater than the width, front and back thickness defining sidewalls being generally outwardly curved, left and right depth defining sidewalls being generally planar, a generally rectangular bottom that has a centrally disposed indentation, a generally rectangular rim having a rim flange that projects inwards so as to define a generally horizontal sealing surface, a lid securing portion located adjacent the rim and comprising a chamfered region and an indented region, and a bottom chamfer arranged where the sidewall meets the bottom.

In embodiments, the indented region is discontinuous.

In embodiments, there is provided a spice container lid comprising a lid base sized and configured to secure the lid to the lid securing portion of a container body and a lid door assembly movably mounted to the lid base. The lid door assembly comprises a main door that can assume at least a closed position with respect to the lid base and an open position with respect to the lid base, a first side door that can assume at least a closed position with respect to the main door and au open position with respect to the main door, and a second side door that can assume at least a closed position with respect to the main door and an open position with respect to the main door.

In embodiments, the main door allows for contents of the container to be spooned out when in the open position.

In embodiments, the first door allows for contents of the container to be poured out when in the open position.

In embodiments, the second door allows for contents of the container to be sifted out when in the open position.

In embodiments, the main door comprises a sealing bead that is configured to engage with a rim of a container when in the closed position.

In embodiments, the main door has a larger cross-sectional area than either the first door or the second door.

In embodiments, the main door is connected to the lid base via a hinge.

In embodiments, the first door overlies and closes a pouring opening formed in the main door when in the closed position.

In embodiments, the pouring opening is generally triangular.

In embodiments, the first door comprises a sealing bead that engages with a pouring opening formed in the main door when in the closed position.

In embodiments, the first door comprises a stacking bead.

In embodiments, the first door is mounted via a hinge.

In embodiments, the second door overlies and closes plural sifting openings formed in the main door when in the closed position.

In embodiments, the plural sifting openings are generally circular.

In embodiments, the second door comprises at least one sealing projection that engages with one of the plural sitting openings formed in the main door when in the closed position.

In embodiments, the first door comprises a stacking bead.

In embodiments, the second door comprises a stacking bead.

In embodiments, the first door is mounted via a hinge.

In embodiments, the second door is mounted via a hinge.

In embodiments, the main door is retained in the closed position by a snap connection disposed opposite a hinge connecting the main door to the lid base.

In embodiments, the first door is mounted via a hinge oriented generally perpendicular to the hinge of the main door.

In embodiments, the second door is mounted via a hinge oriented generally perpendicular to the hinge of the main door.

In embodiments, the first door is retained in the closed position by a snap connection and is mounted via a hinge.

In embodiments, the first door is retained in the closed position by a snap connection and is mounted via a hinge.

In embodiments, the first door is connected via a hinge to a connecting section non-removably coupled to the main door.

In embodiments, the second door is connected via a hinge to a connecting section non-removably coupled to the main door.

In embodiments, a connecting section is non-removable connected to the main door, the first door is connected via a hinge to a first side of the connecting section and the second door is connected via a hinge to a second side of connecting section.

In embodiments, the lid base is connectable to a lid securing portion so that removal of the lid base requires greater force than opening the main door.

In embodiments, a force required to open either of the first and second doors is less than that required to open the main door.

In embodiments, the lid base and the main door are an integrally formed member connected by a living hinge.

In embodiments, the first and second doors are arranged on an integrally formed member having a central section that is connectable to the main door.

In embodiments, the first and second doors are each connected to the central section by a living hinge.

In embodiments, the lid is made of a synthetic resin material.

In embodiments, there is provided a container lid comprising a generally rectangular lid base sized and configured to secure the lid to the lid securing portion of a container body and a lid door assembly movably mounted to the lid base. The lid door assembly comprises a generally rectangular main door that can assume at least a closed position with respect to the lid base and an open position with respect to the lid base, said main door comprising indicia indicative or descriptive of a spoon, a first side door that can assume at least a closed position with respect to the main door and an open position with respect to the main door, said first side door comprising indicia indicative or descriptive of a pouring opening, and a second side door that can assume at least a closed position with respect to the main door and an open position with respect to the main door, said second side door comprising indicia indicative or descriptive of sifting openings.

In embodiments, the indicia indicative or descriptive of a spoon comprises a spoon-shaped symbol.

In embodiments, the indicia indicative or descriptive of a pouring opening comprises a generally triangular shaped opening symbol.

In embodiments, the indicia indicative or descriptive of sifting openings comprises generally circular shaped opening symbols.

In embodiments, the invention also provides for a container assembly comprising a container comprising a generally rectangular cross-section having a width that is greater than a depth, a generally rectangular bottom, a generally rectangular rim, a lid securing portion located adjacent the rim and comprising a chamfered region and an indented region, and a height that is greater than the width. A multi-door lid comprises a lid base sized and configured to secure the lid to the lid securing portion of the container body, such that when installed, an upper end of the lid base is disposed at or below an upper end of the rim. A lid door assembly comprises a spoon door connected to the lid base via a main hinge, a pour door connected to the spoon door via a first hinge, and a sift door connected to the spoon door via a second hinge. The first and second hinges are oriented generally parallel to one another and generally perpendicular to the main hinge.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

The figures are intended to show basic features, functioning and aid in understanding and may or may not show features or details which are utilized in commercial embodiments.

DETAILED DESCRIPTION OF THE INVENTION

The present invention is further described in the detailed description which follows, in reference to exemplary embodiments.

Non-limiting Example

Figure 1:
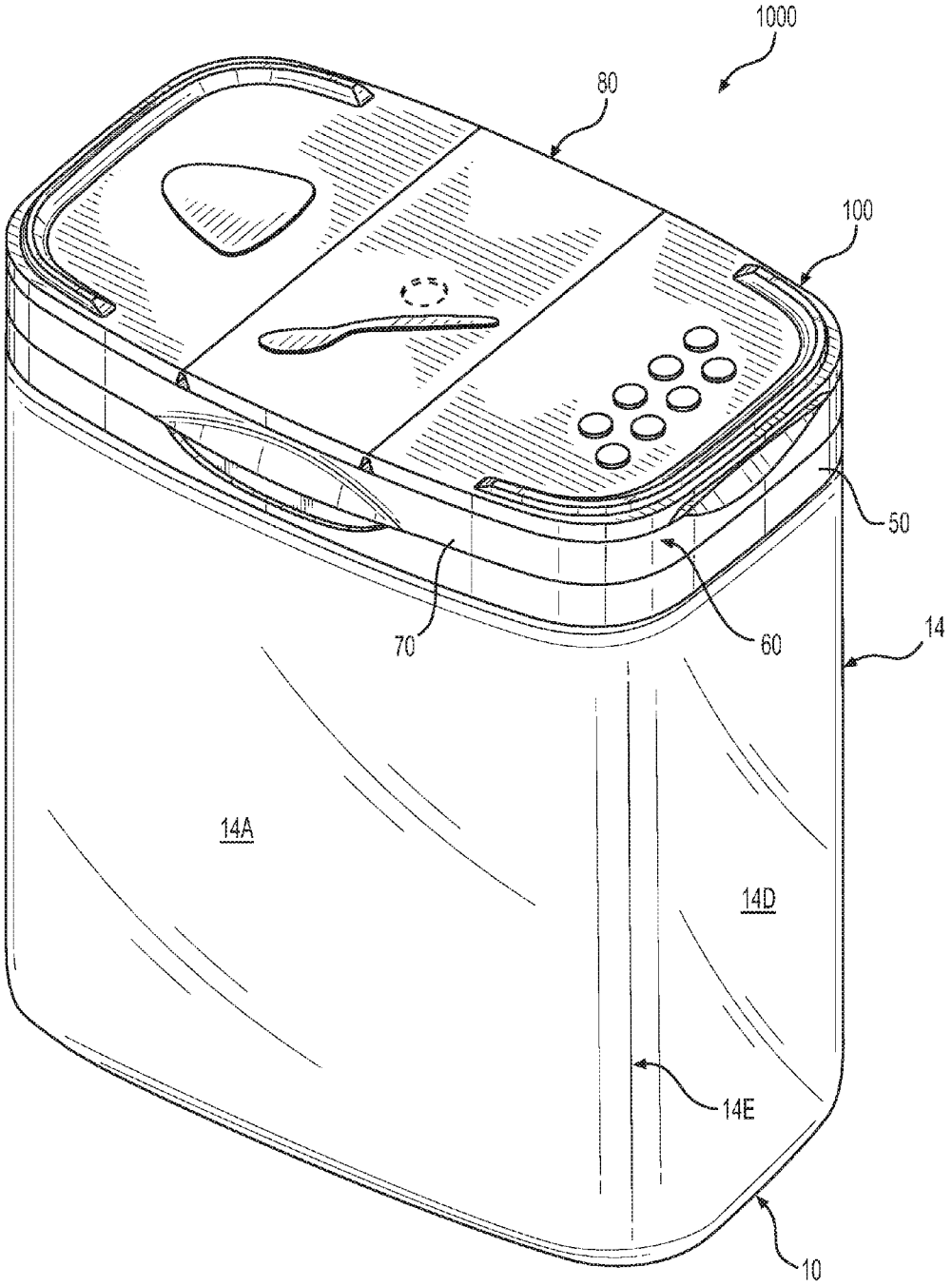
FIG. 1 shows a container with an installed three door lid in accordance with the invention with the lid being shown in a closed position.
Figure 2:
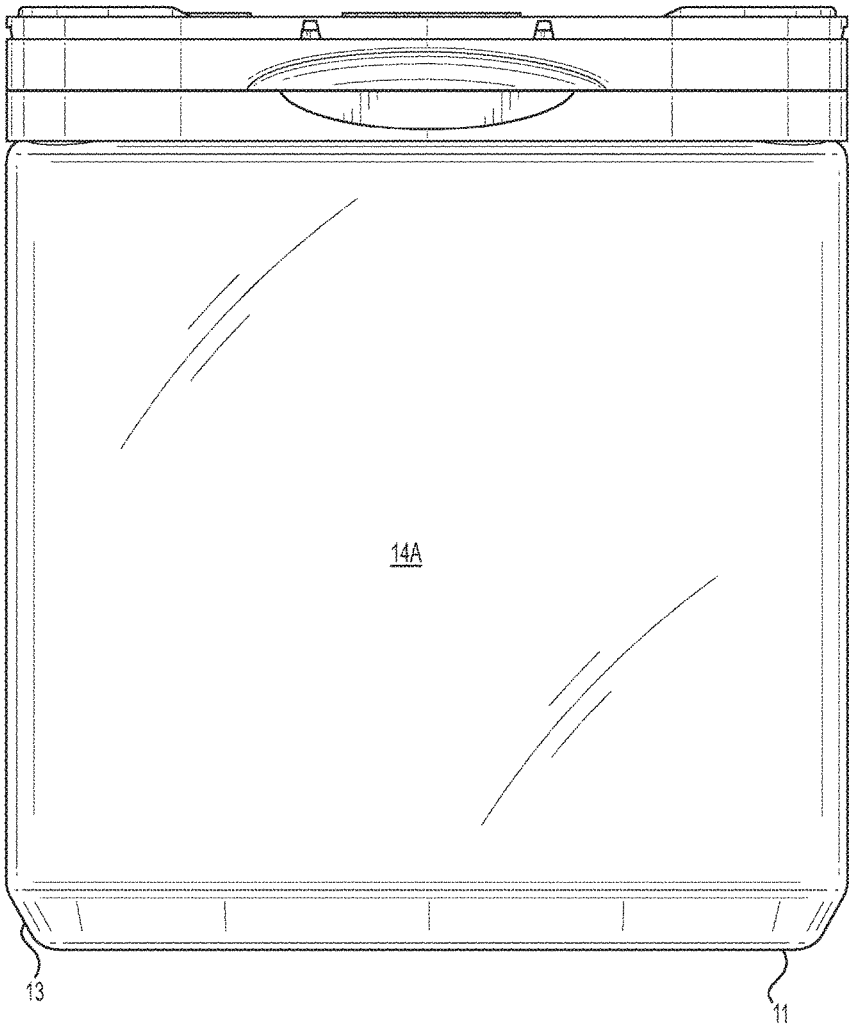
FIG. 2 shows a front view of FIG. 1.
Figure 3:
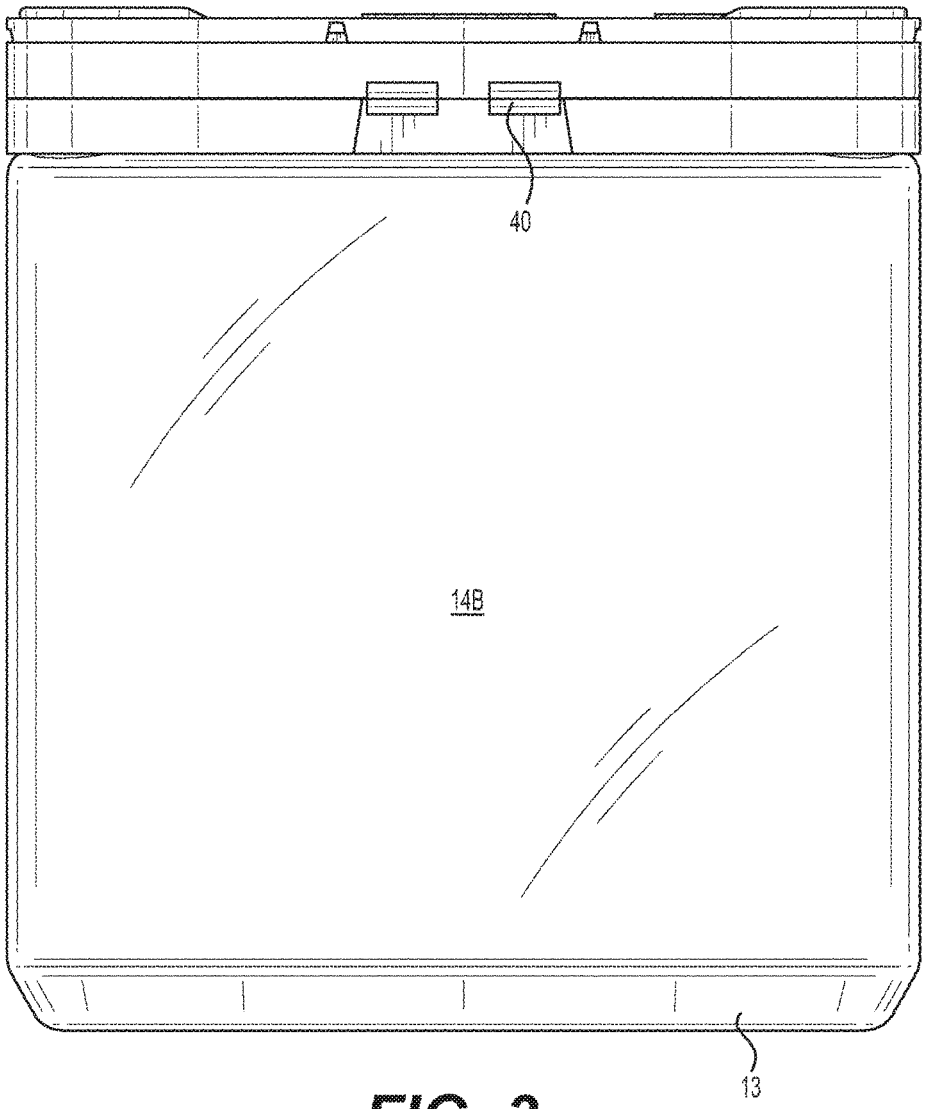
FIG. 3 shows a rear view of FIG. 1.
Figure 4:
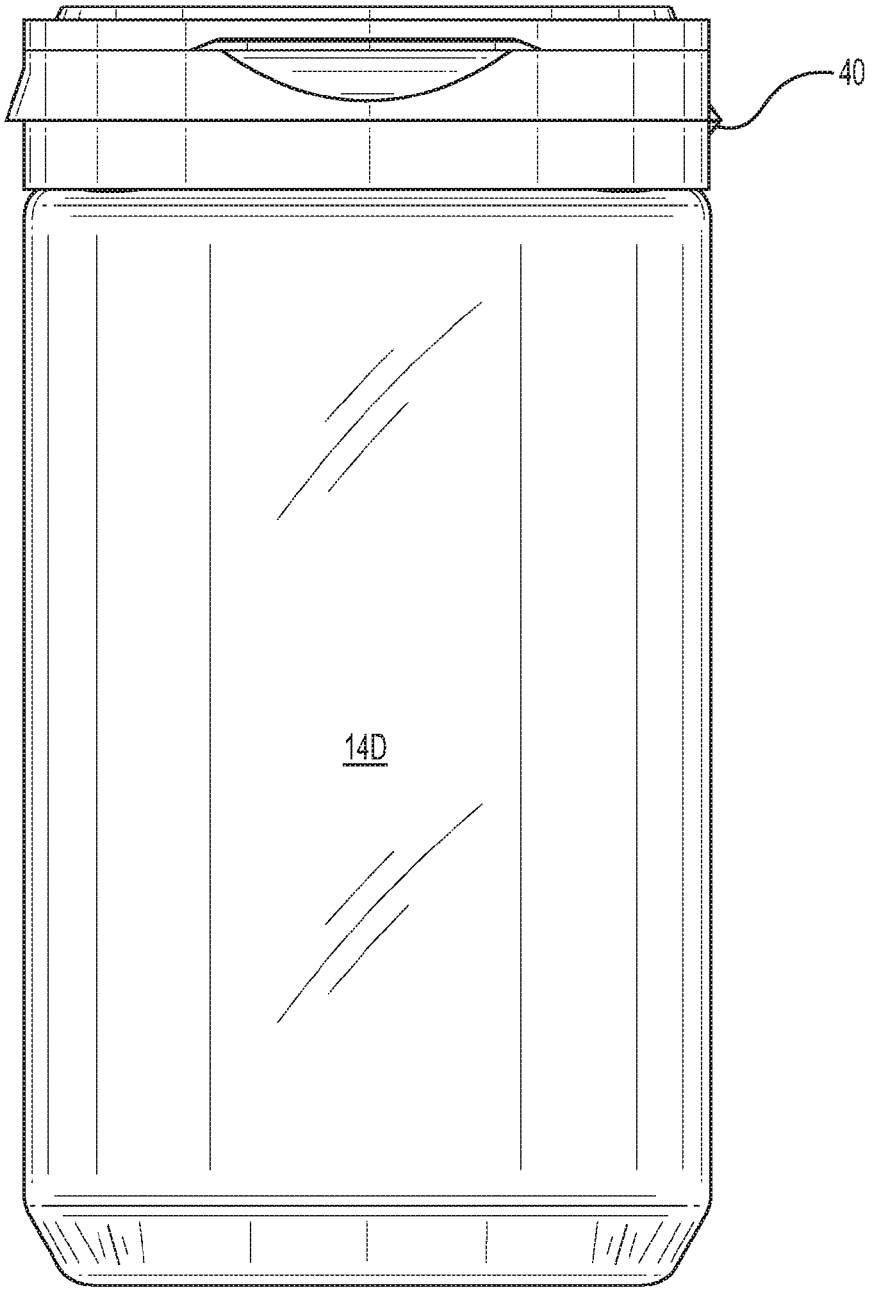
FIG. 4 shows a right side view of FIG. 1.
Figure 5:
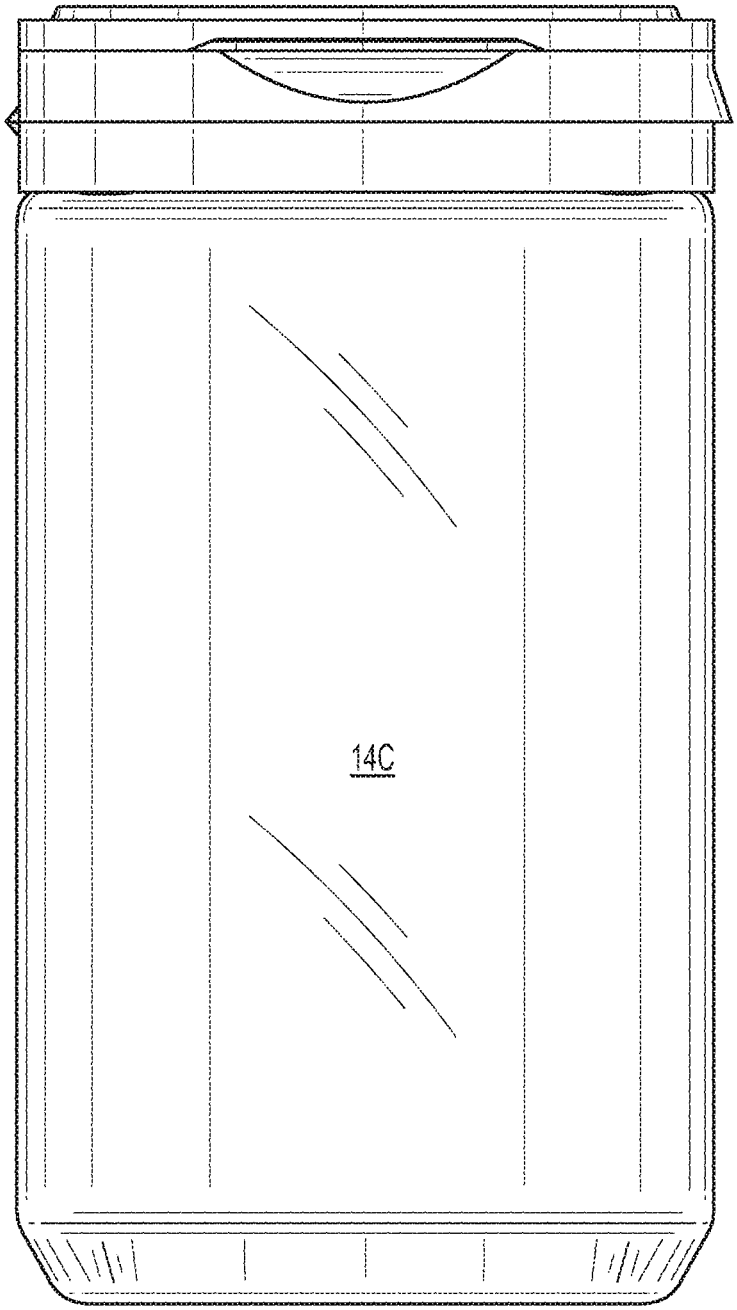
FIG. 5 shows a left side view of FIG. 1.
Figure 6:
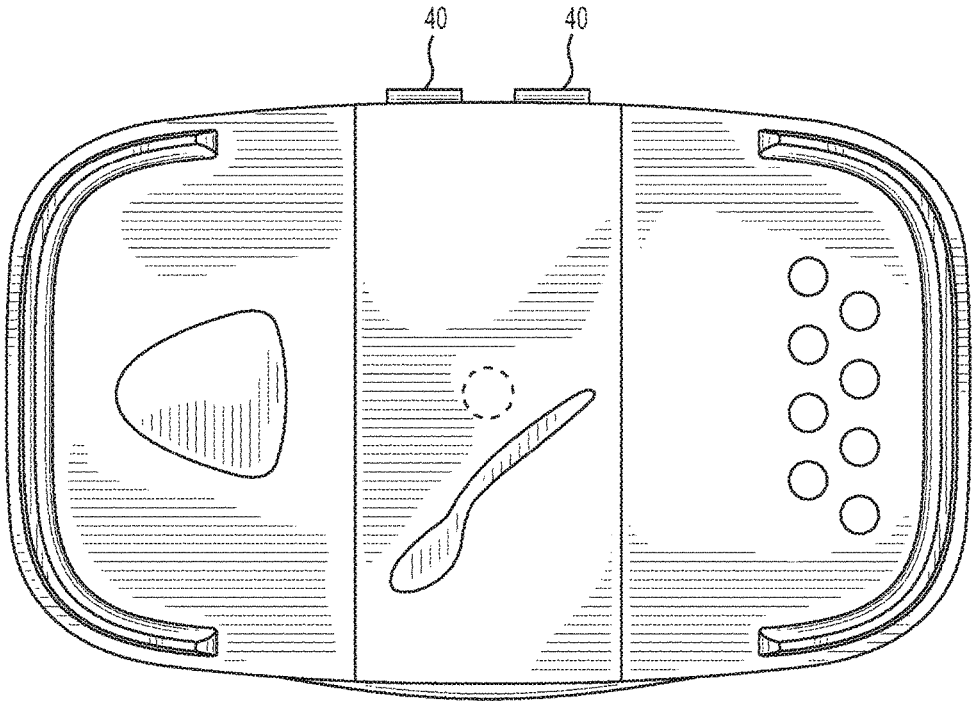
FIG. 6 shows a top view of FIG. 1.
Figure 7:
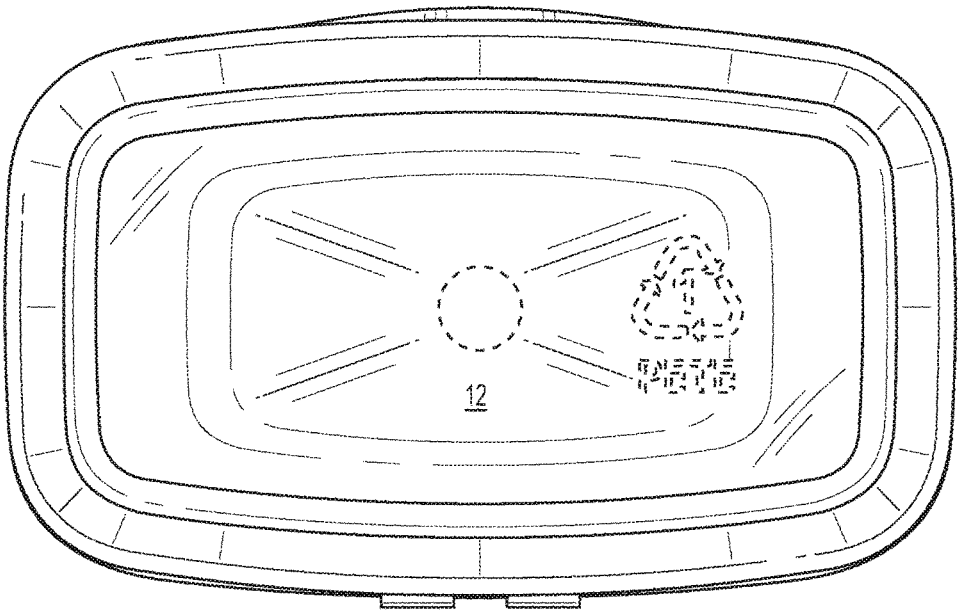
FIG. 7 shows a bottom view of FIG. 1.
Figure 8:
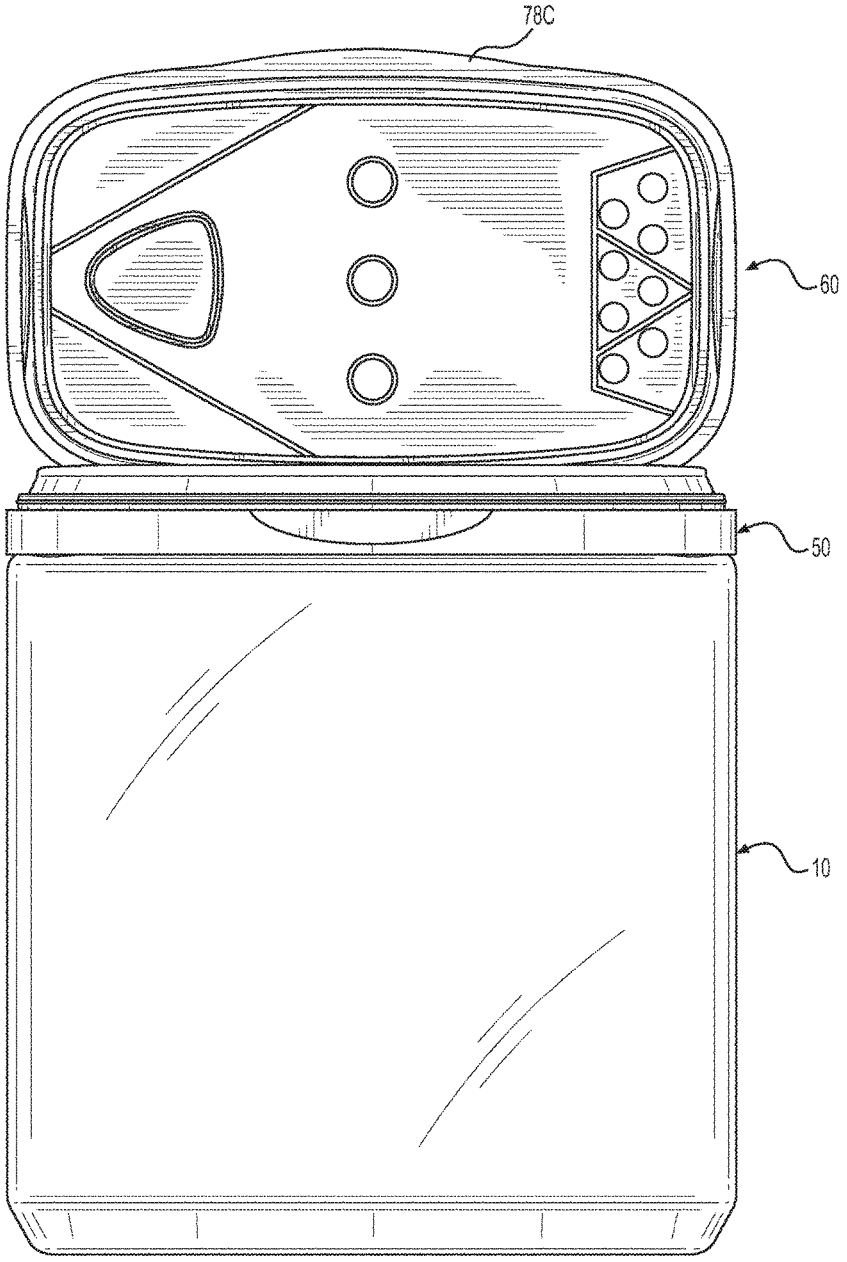
FIG. 8 shows the container with an installed three door lid of FIG. 1 with the lid being shown in an open position.
Figure 9:
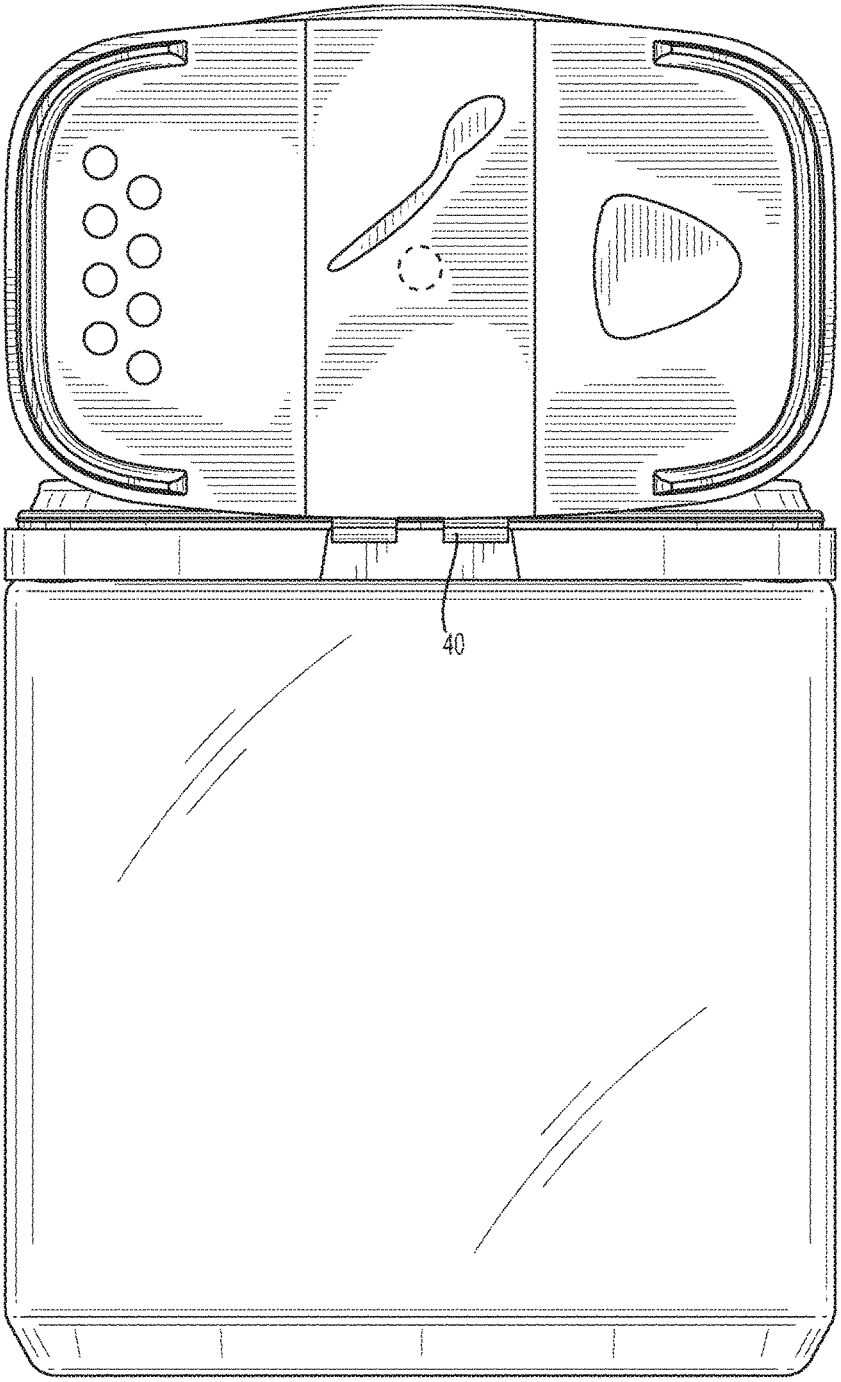
FIG. 9 shows a rear view of FIG. 8.
Figure 10:
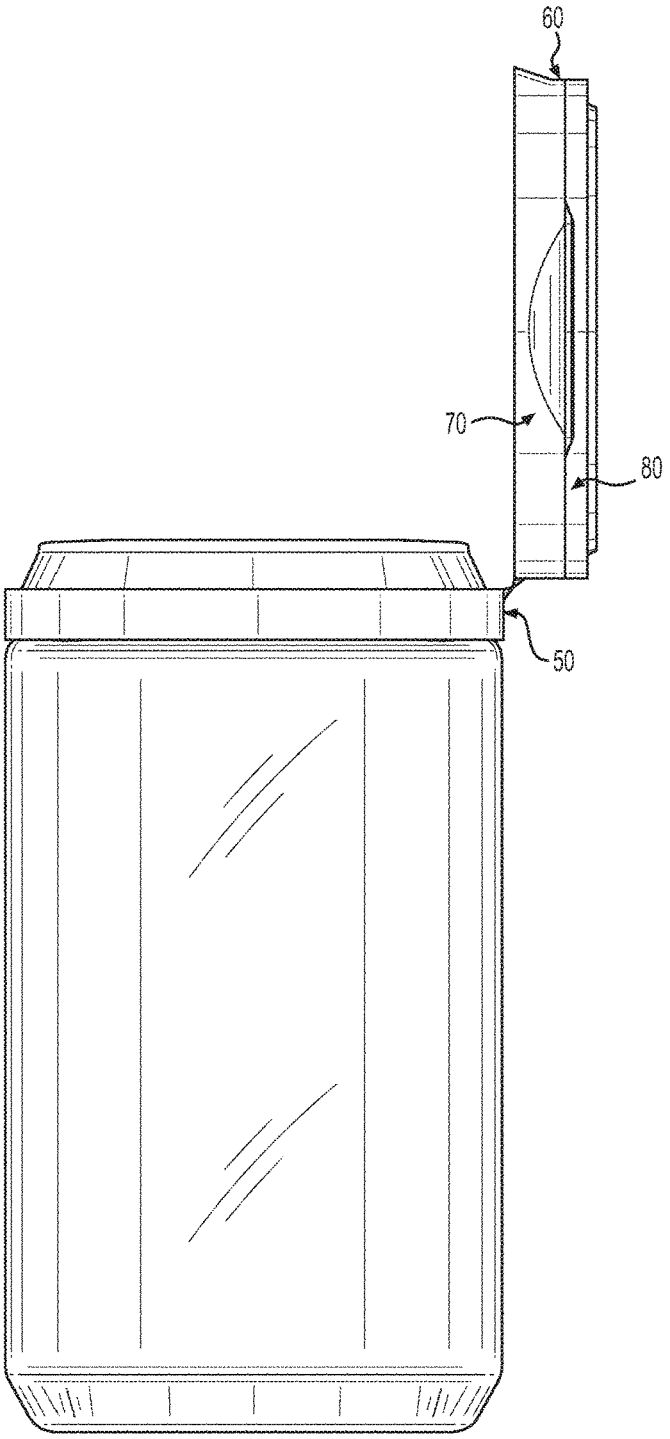
FIG. 10 shows a right view of FIG. 8.
Figure 11:
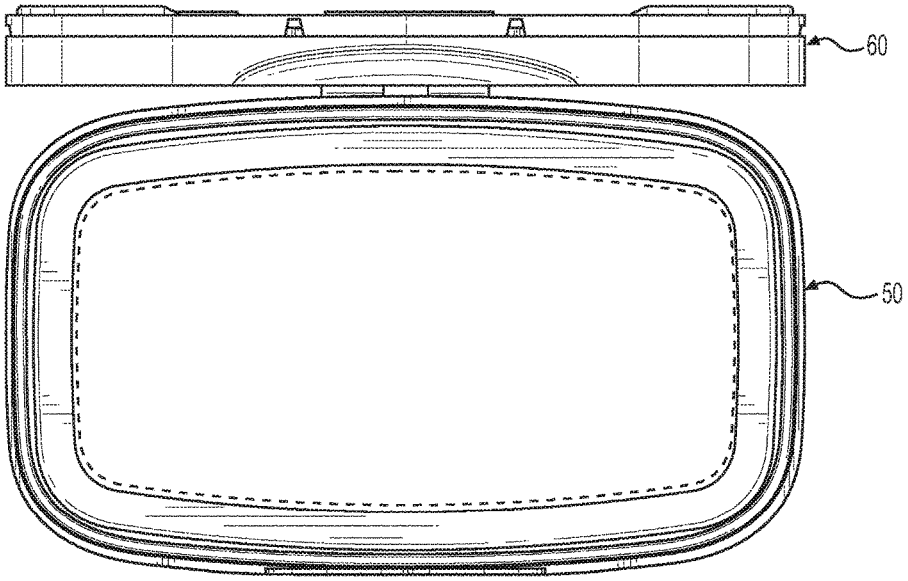
FIG. 11 shows a top side view of FIG. 8.
Figure 12:
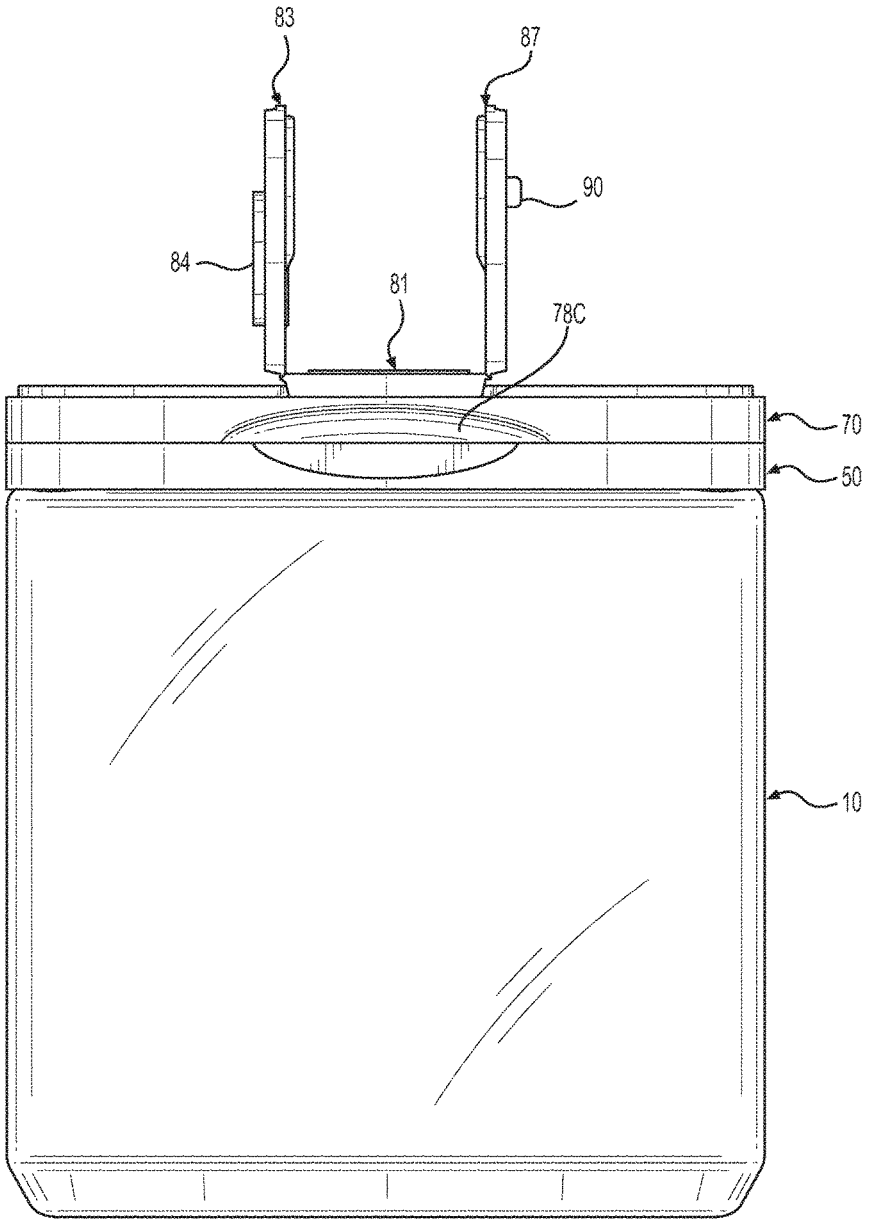
FIG. 12 shows the container with an installed three door lid of FIG. 1 with the two side doors of the lid being shown in an open position.
Figure 13:
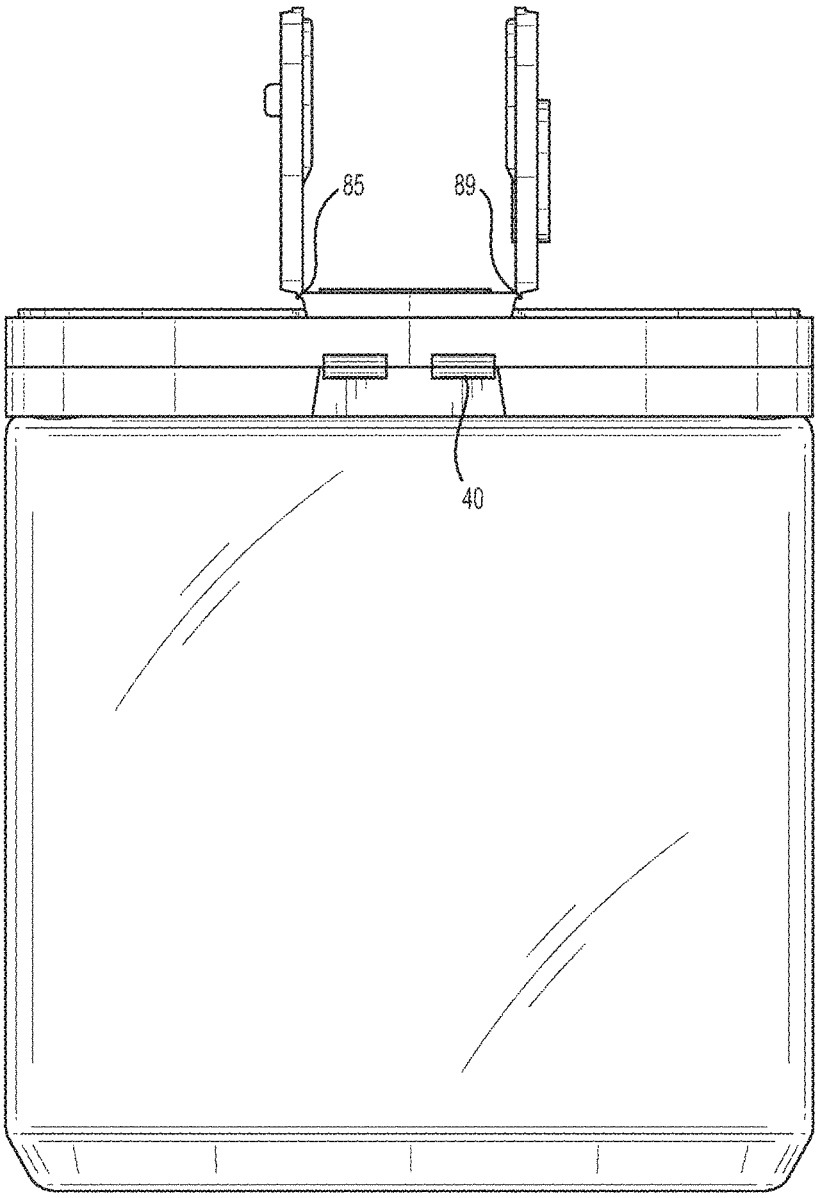
FIG. 13 shows a rear view of FIG. 12.
Figure 14:
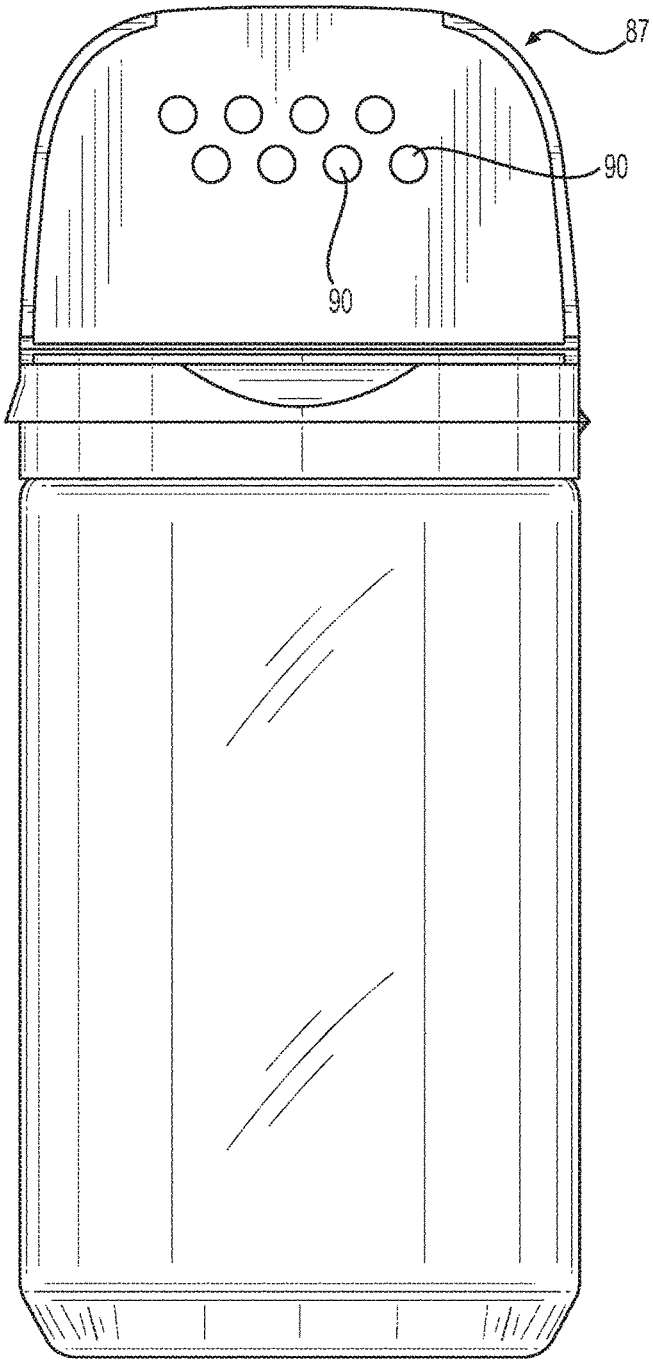
FIG. 14 shows a right view of FIG. 12.
Figure 15:
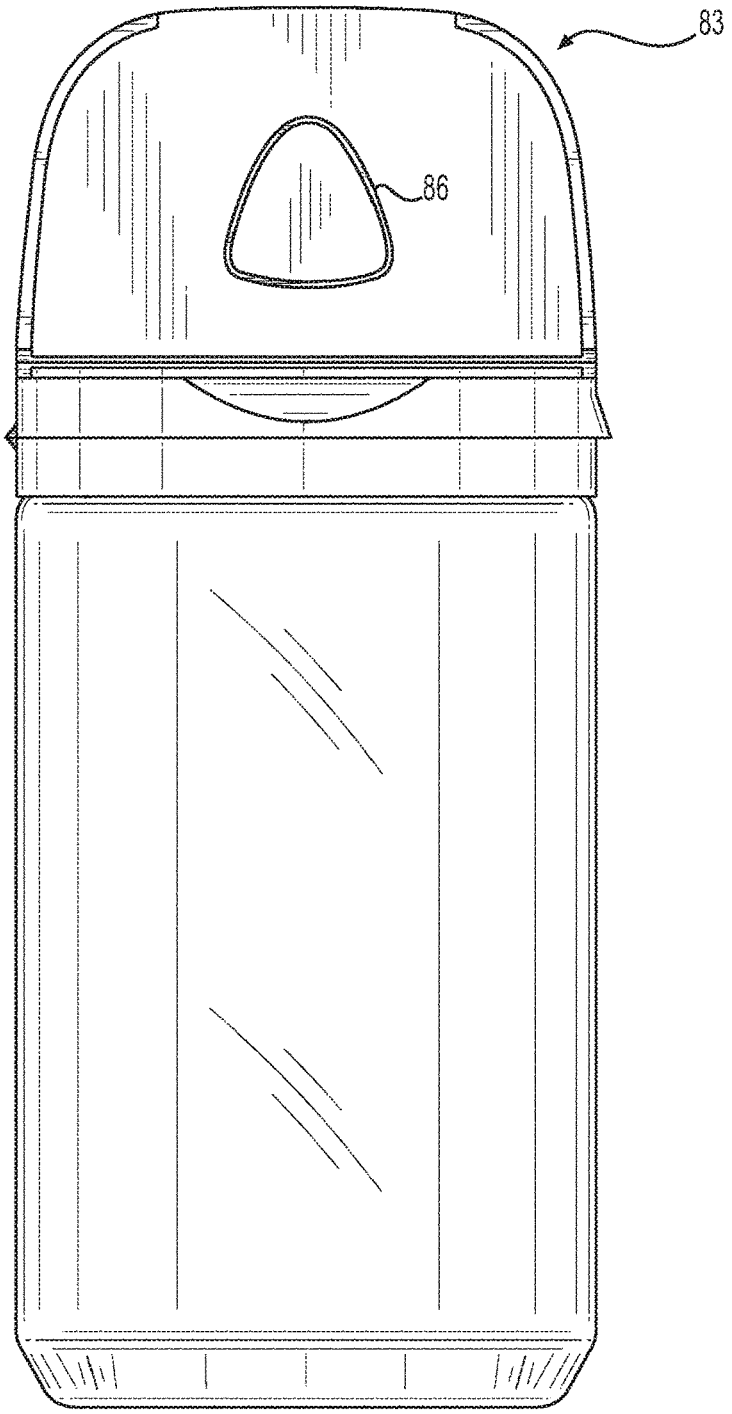
FIG. 15 shows a left side view of FIG. 12.
Figure 16:
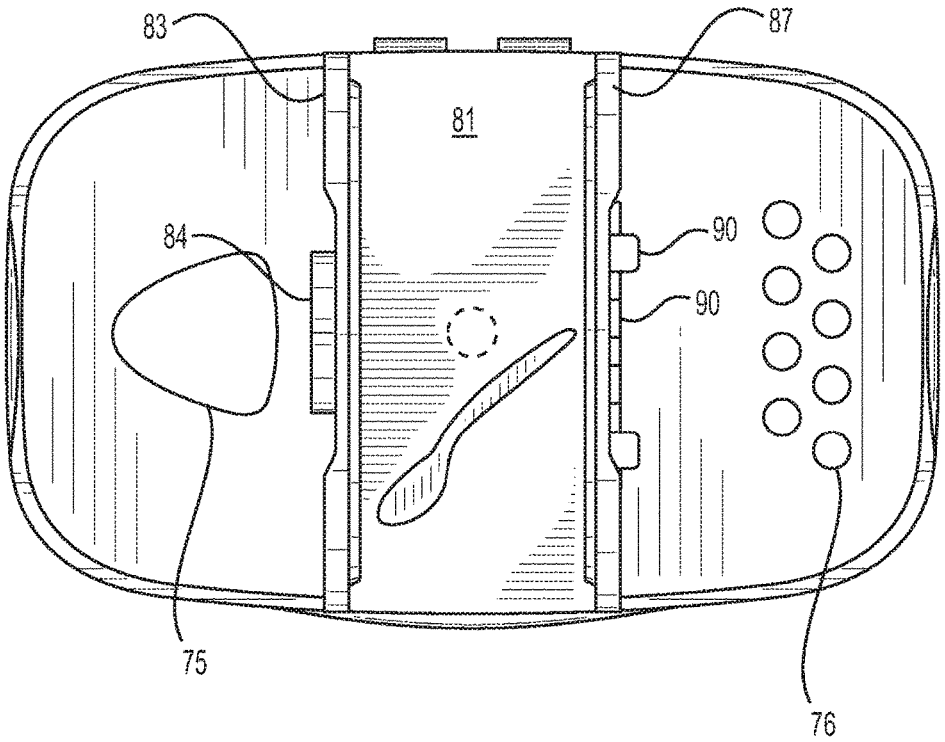
FIG. 16 shows a top side view of FIG. 12.
Figure 17:
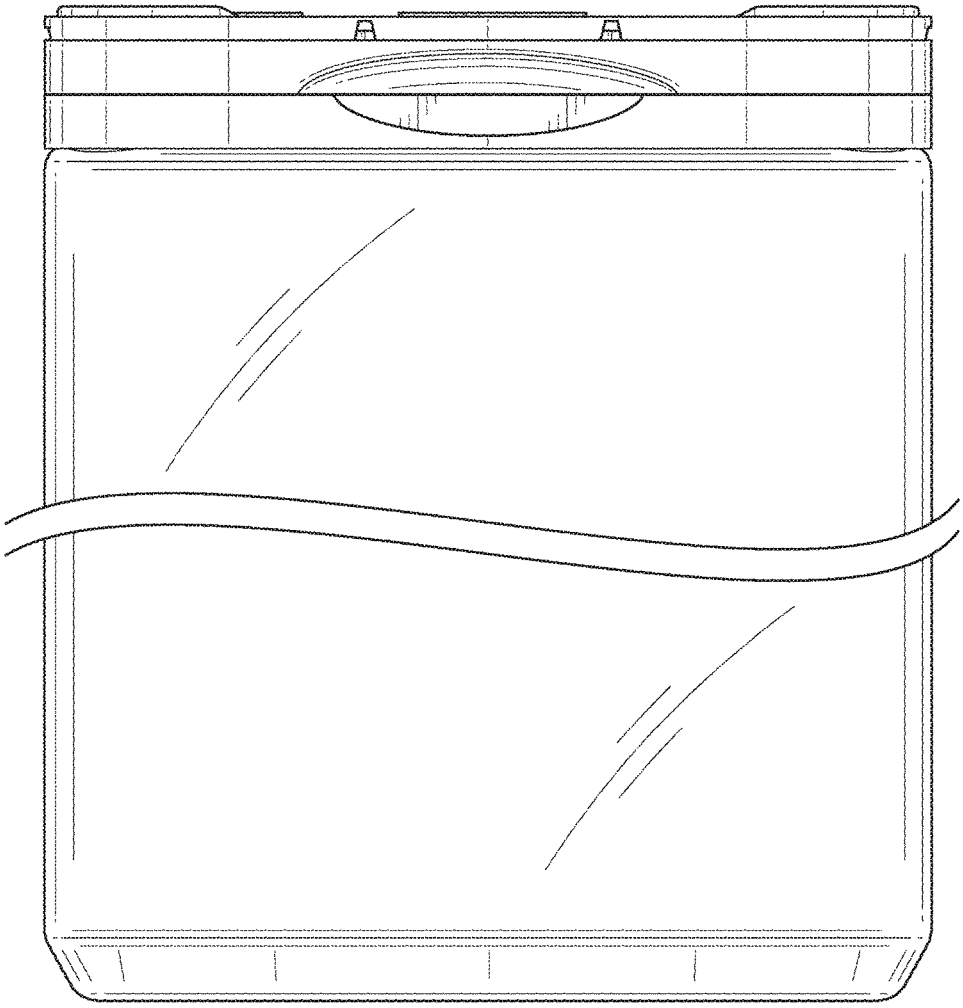
FIGS. 17 and 18 show various views of another container with a three door lid with the container being shown of variable height in order to increase container volume. Exemplary volumes range from 1 to 32 ounces (and metric or gram equivalents) and any whole number and/or decimal values between the same such, e.g., as 2.12 ounces or 60 grams.
Figure 18:
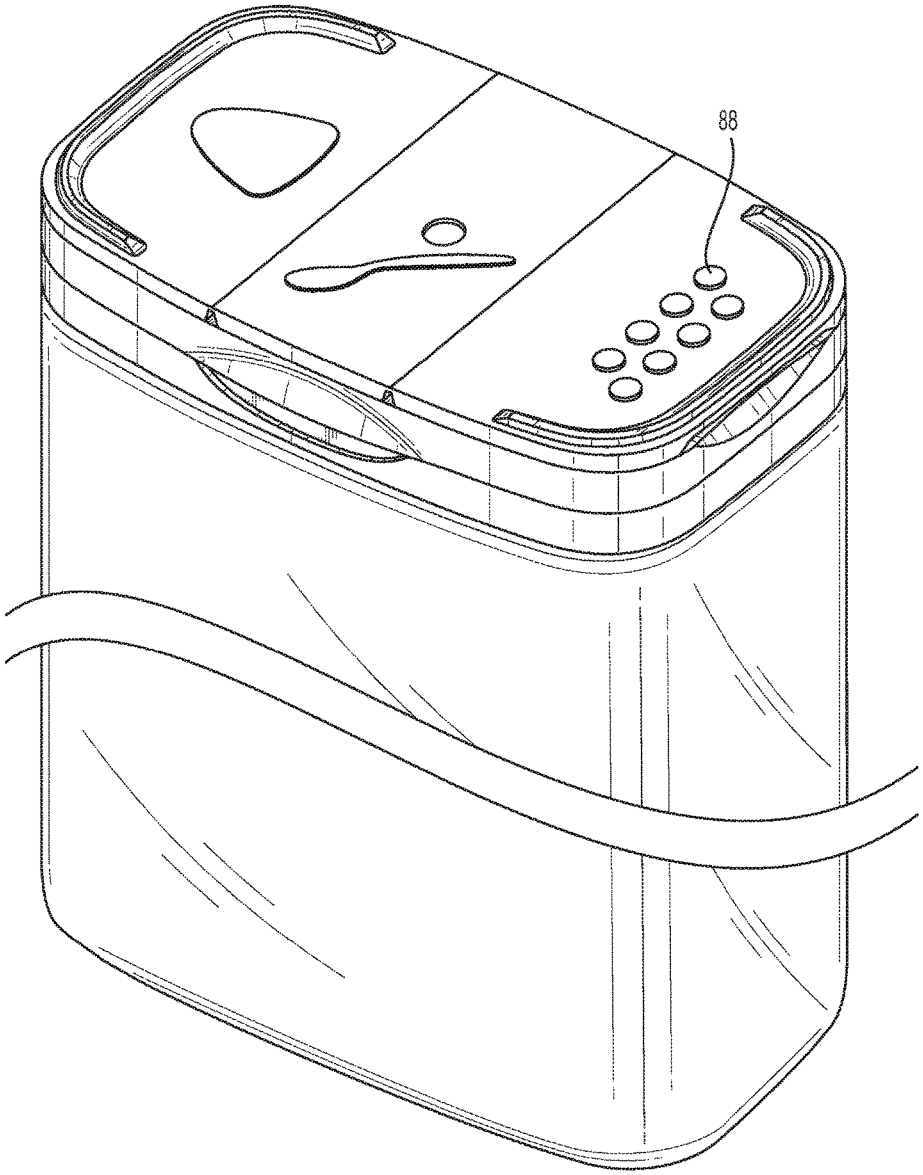
Figure 19:
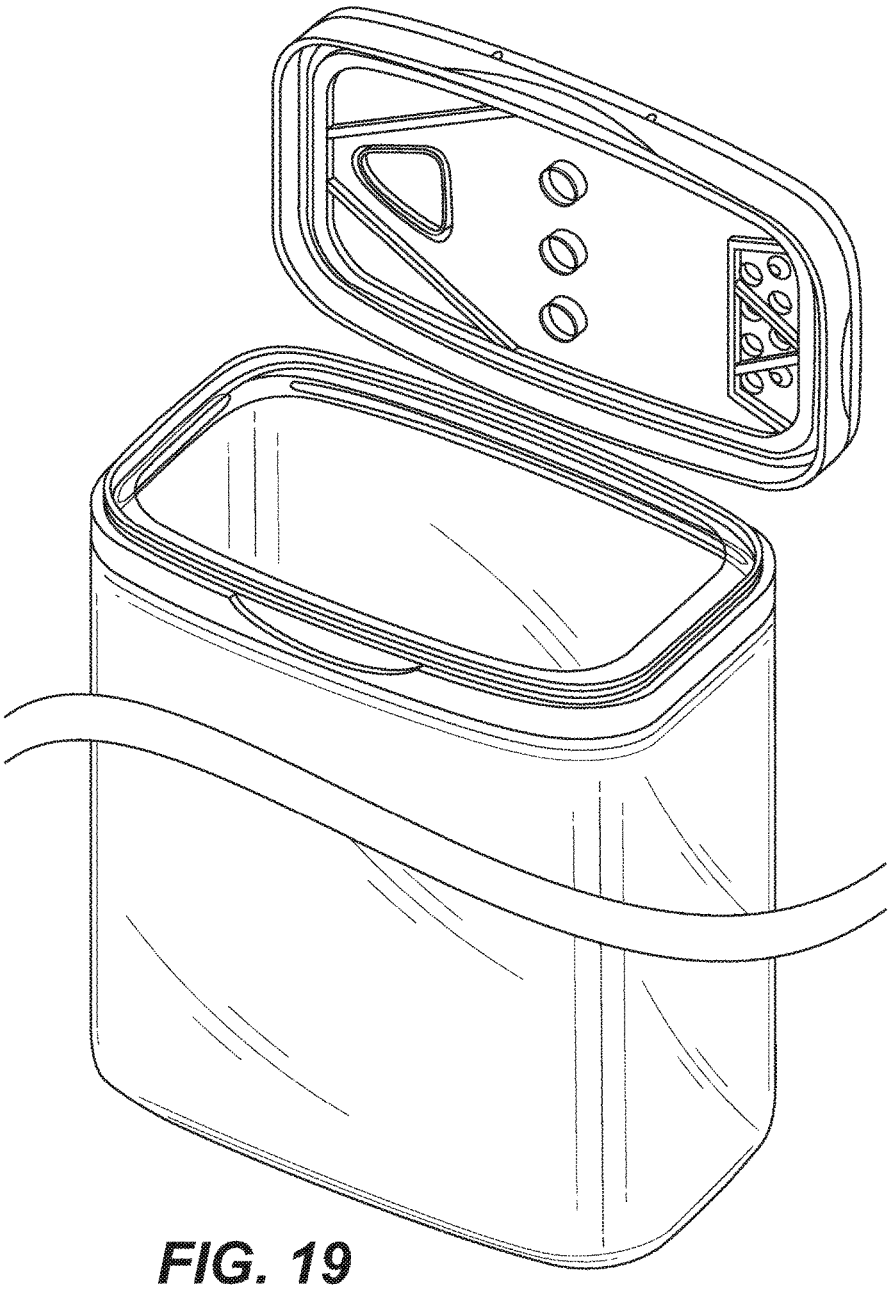
FIG. 19 shows the container of FIG. 17 with the main lid door open 90 degrees.
Figure 20:
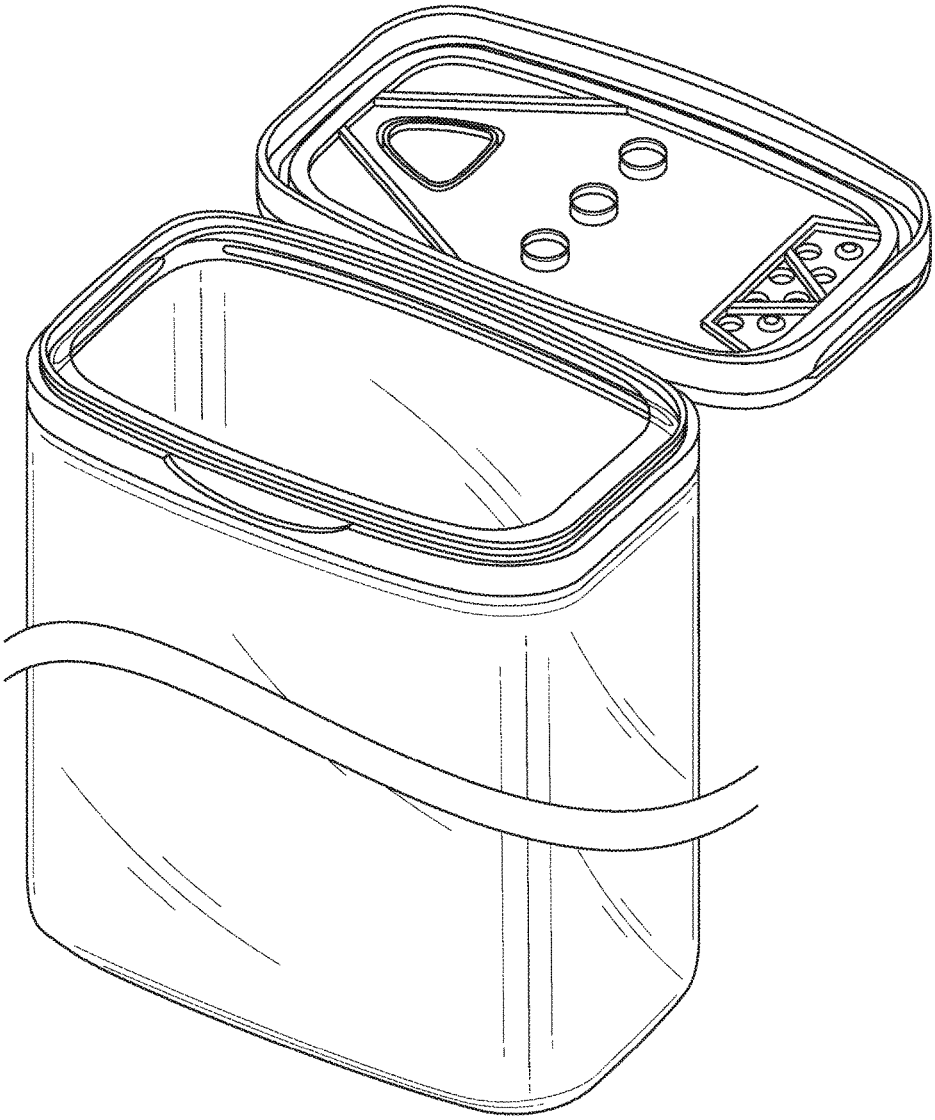
FIG. 20 shows the container of FIG. 17 with the main lid door open 180 degrees.
Figure 21:
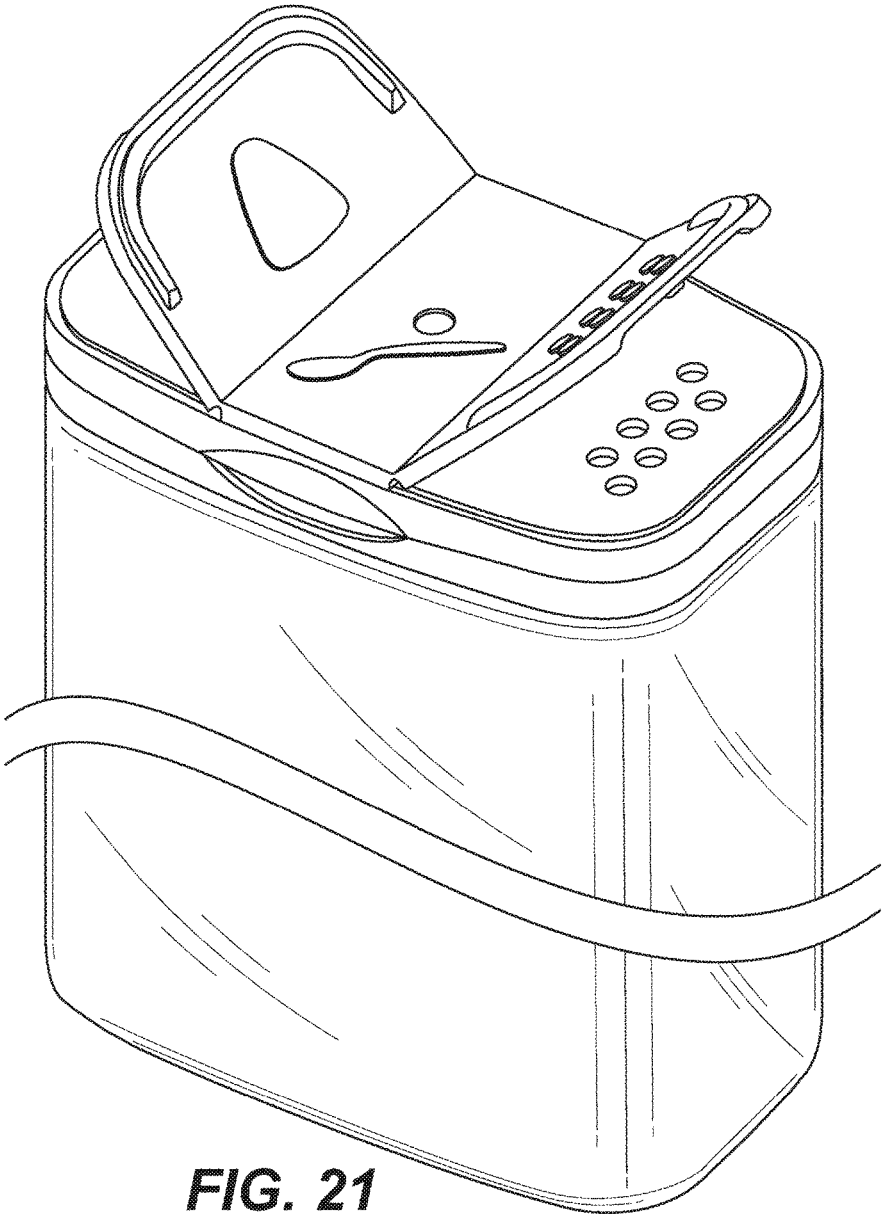
FIG. 21 shows the container of FIG. 17 with the two side doors door open about 45 degrees.
Figure 22:
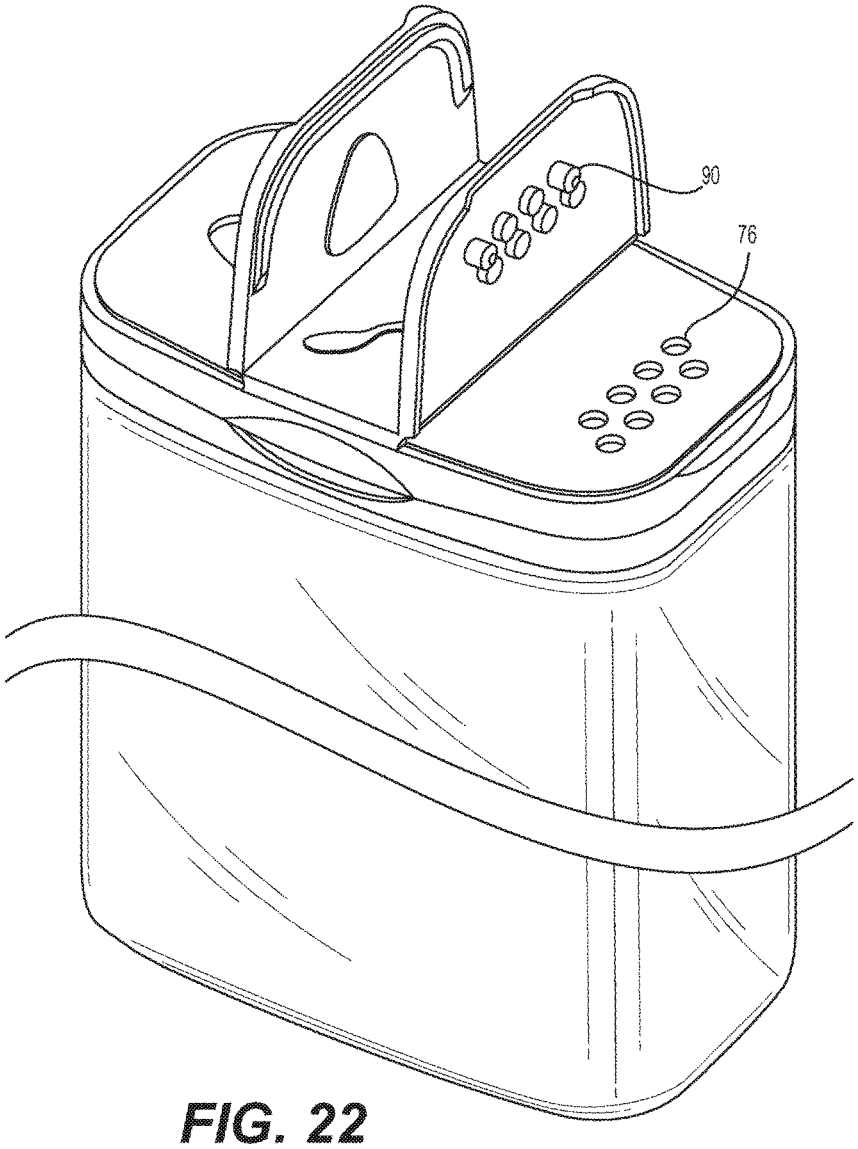
FIG. 22 shows the container of FIG. 17 with the two side doors door open about 90 degrees.
Figure 23:
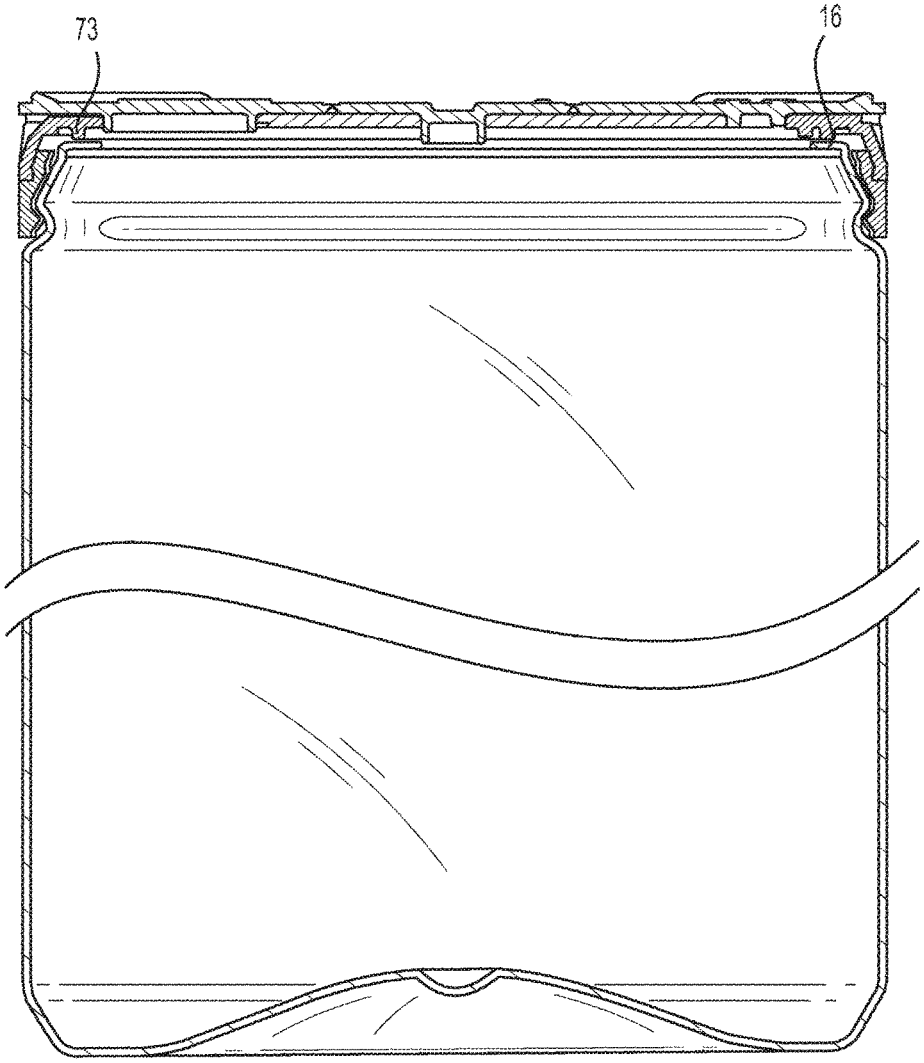
FIG. 23 shows a cross-section of the embodiment of FIG. 17.
Figure 24:
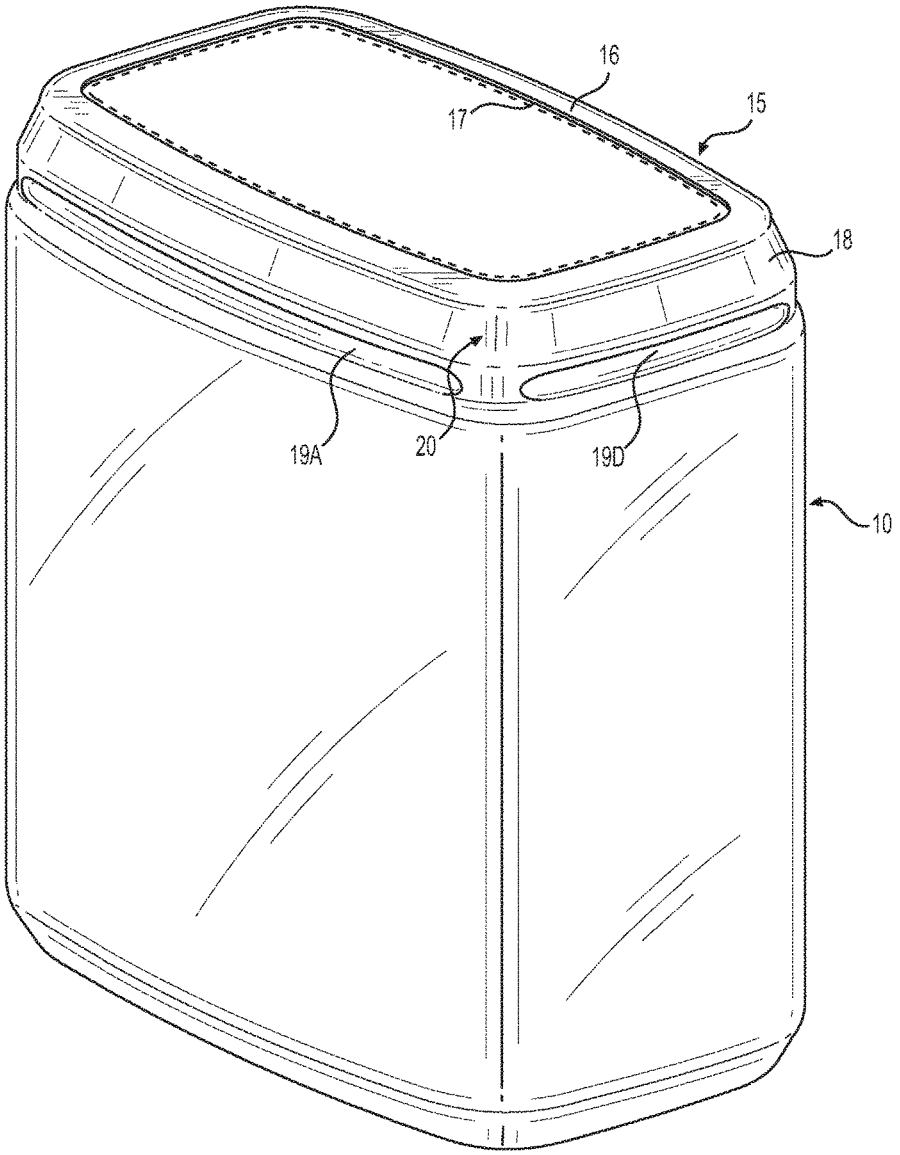
FIG. 24 shows a view of the container utilized on the embodiment of FIG. 1. The broken lines represent a main opening shape of the container.
Figure 25:
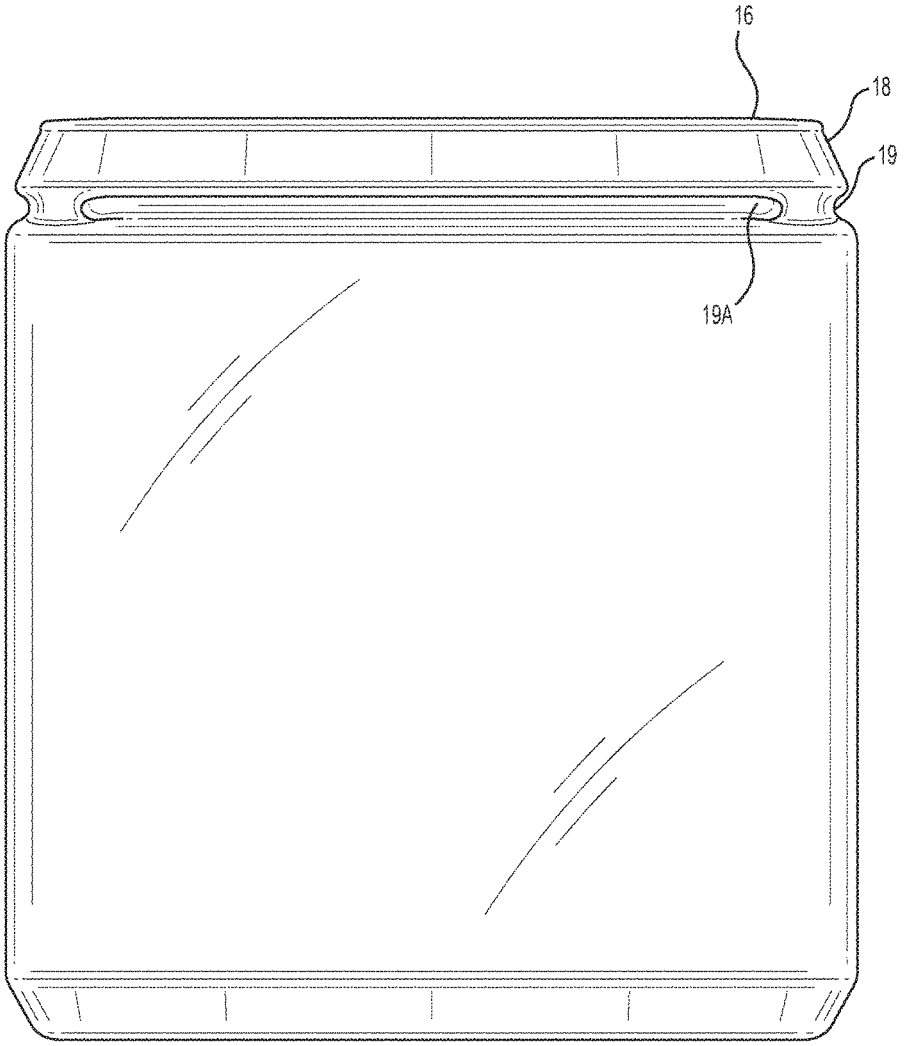
FIG. 25 shows a front view of FIG. 24.
Figure 26:
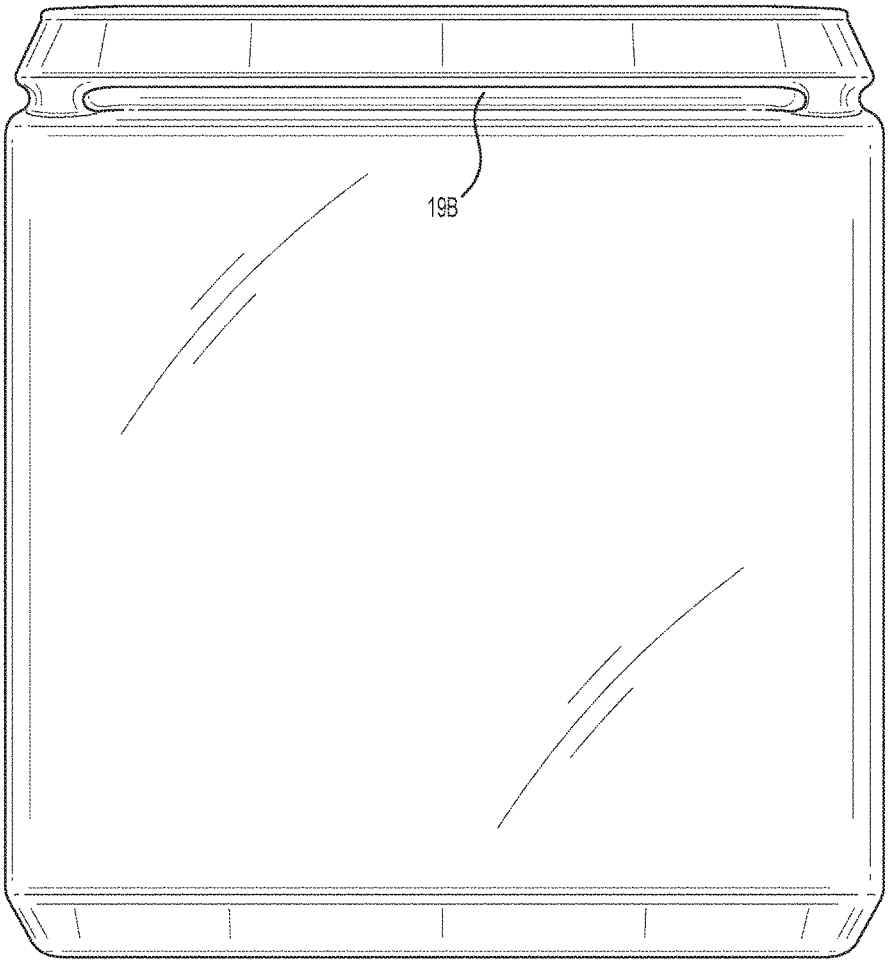
FIG. 26 shows a rear view of FIG. 24.
Figure 27:
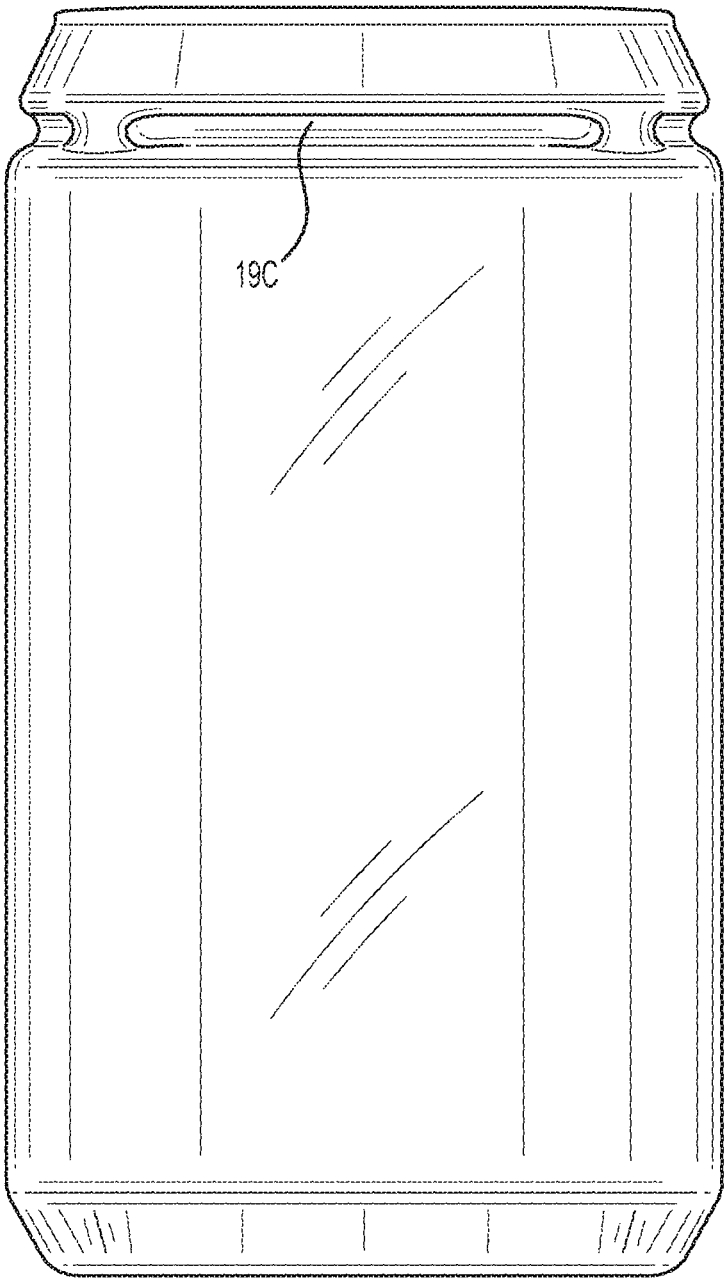
FIG. 27 shows a right side view of FIG. 24.
Figure 28:
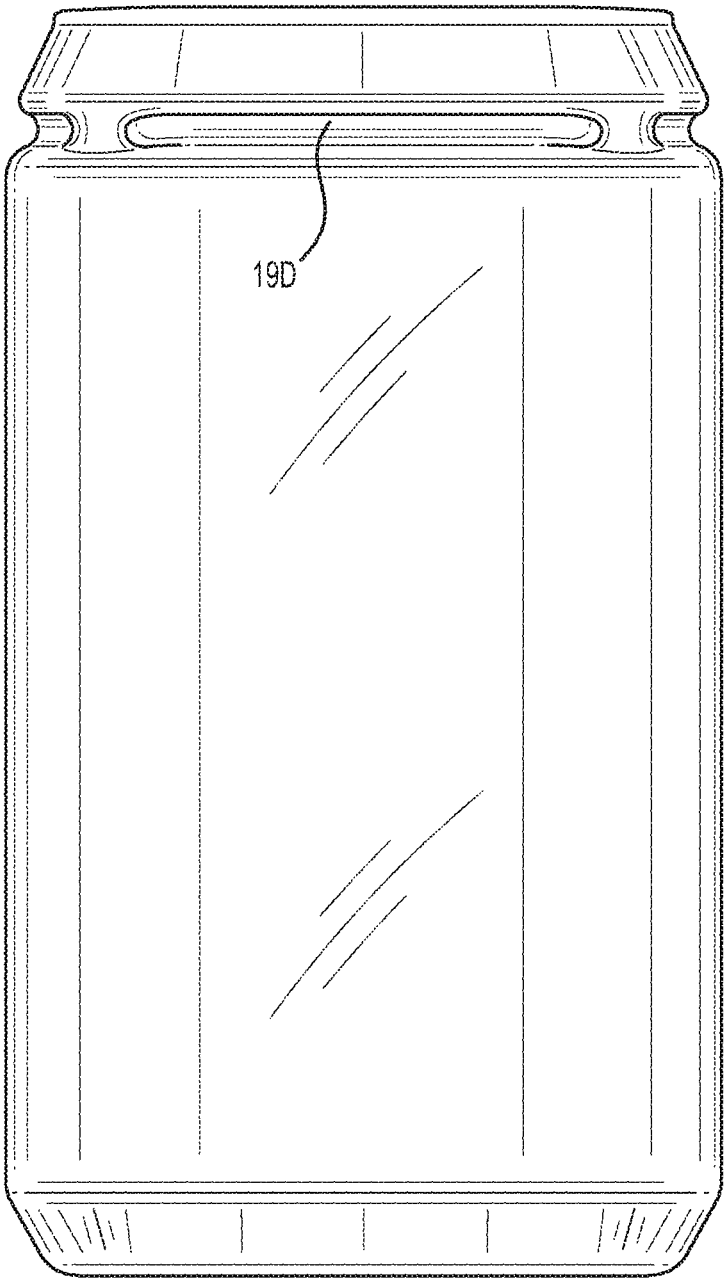
FIG. 28 shows a left side view of FIG. 24.
Figure 29:
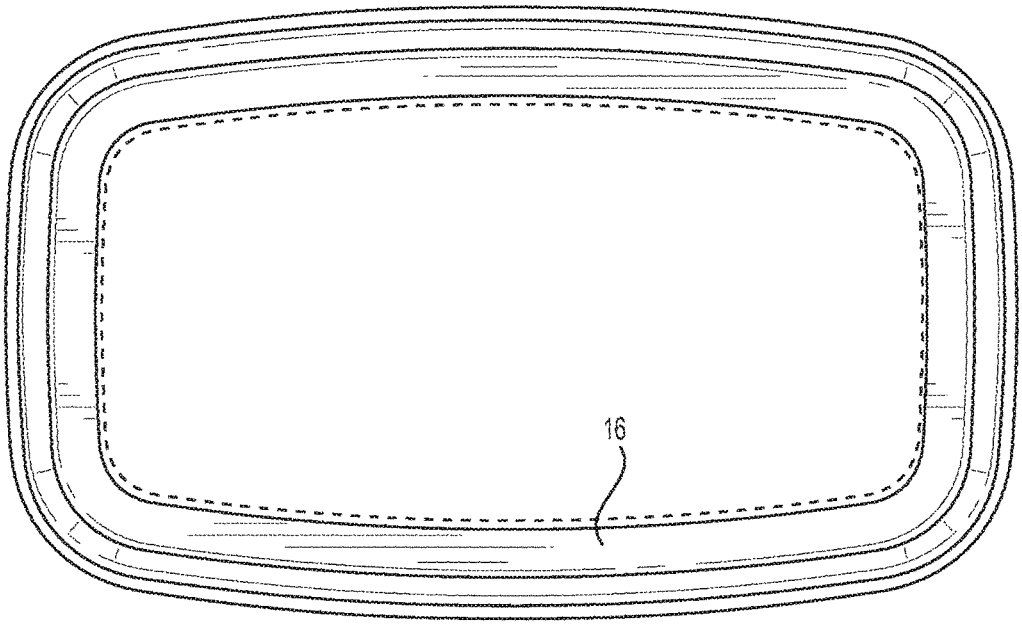
FIG. 29 shows a top view of FIG. 24.
Figure 30:
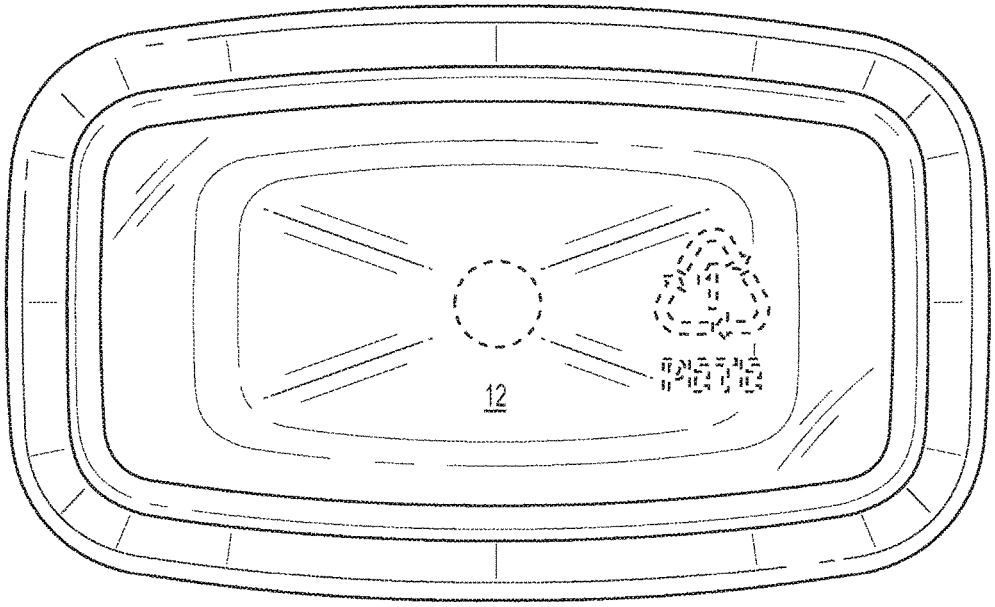
FIG. 30 shows a bottom view of FIG. 24.
Figure 31:
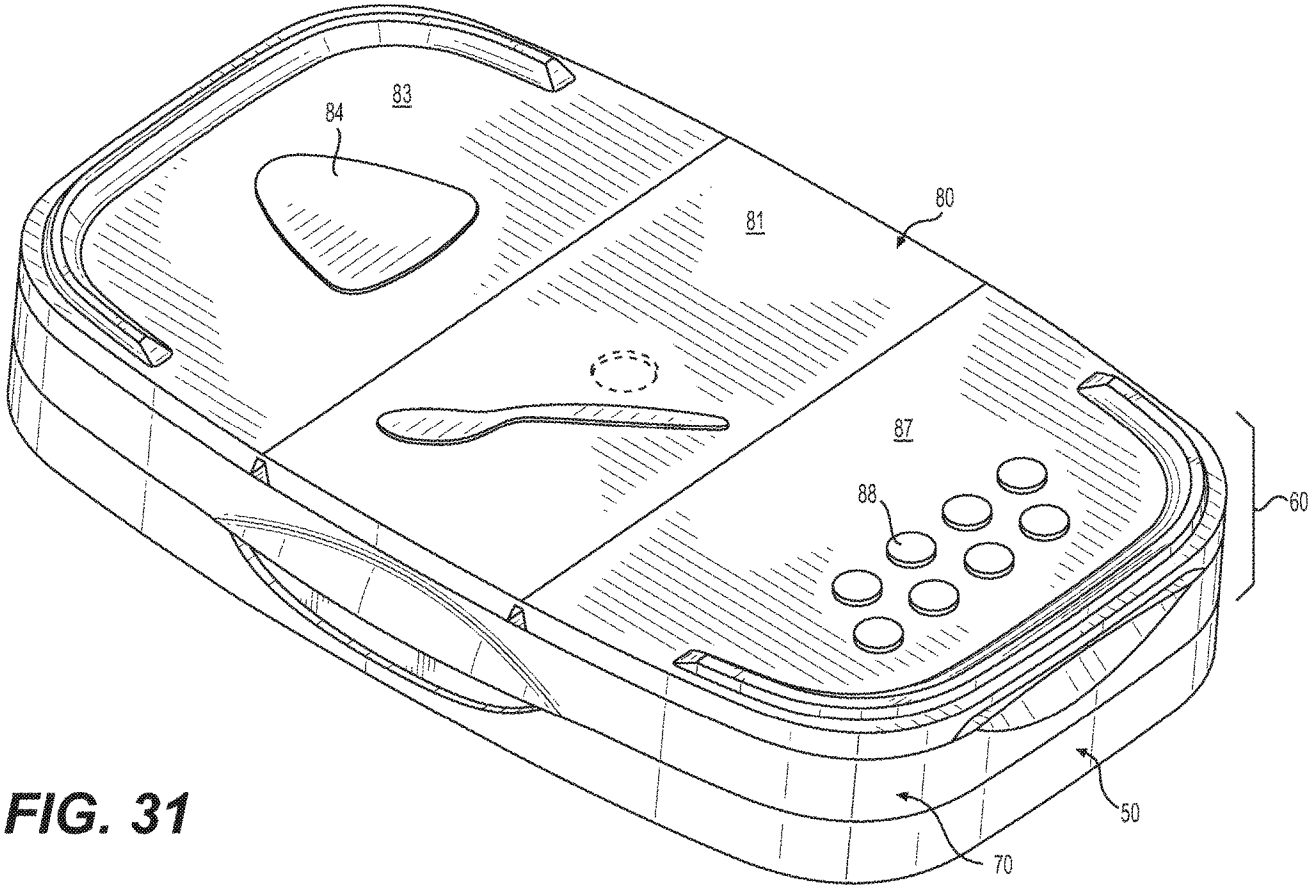
FIG. 31 shows a view of the three door lid utilized on the embodiment of FIG. 1. The broken lines represent circular feature shapes that can vary in size and/or number.
Figure 32:
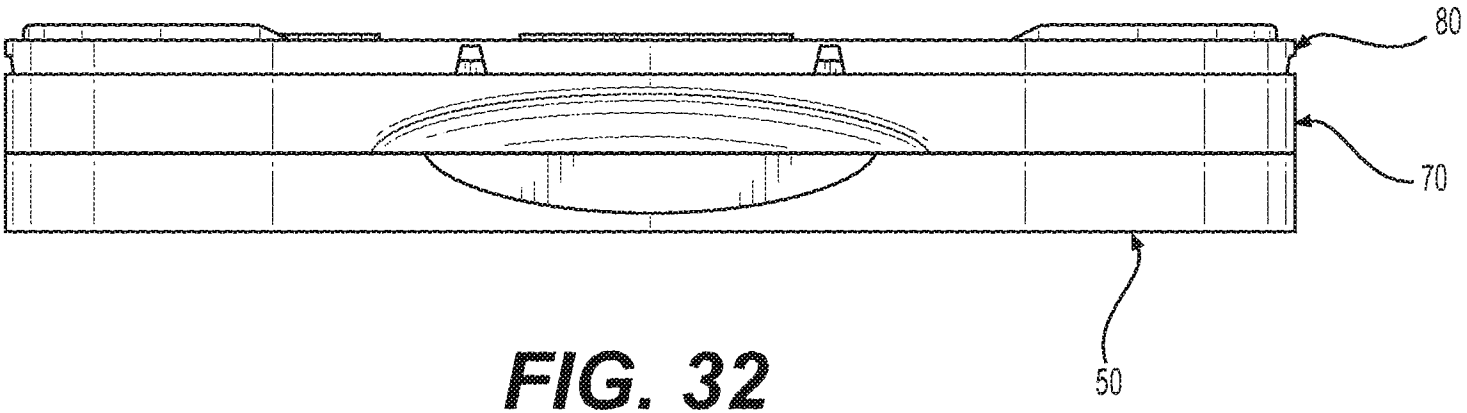
FIG. 32 shows a front view of FIG. 31.
Figure 33:
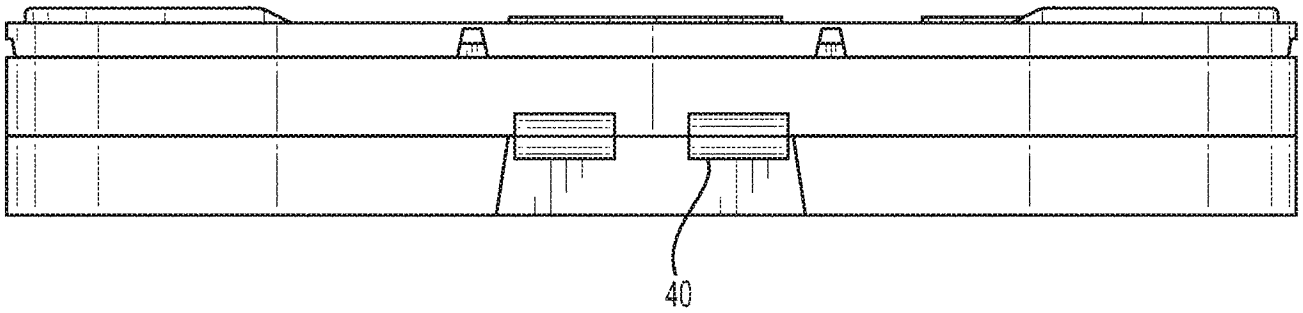
FIG. 33 shows a rear view of FIG. 31.
Figure 34:
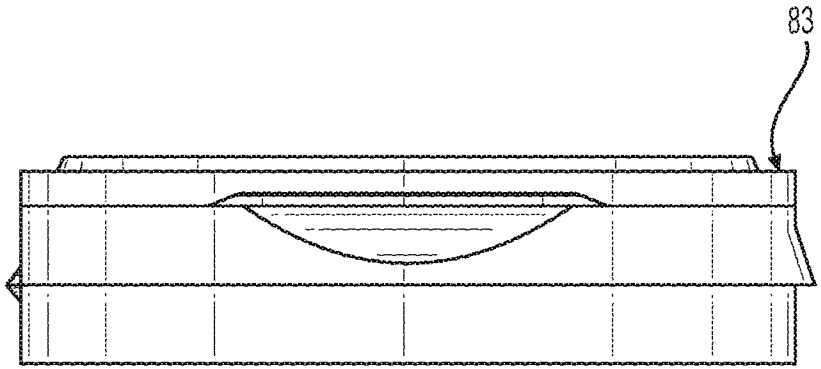
FIG. 34 shows a left side view of FIG. 31.
Figure 35:
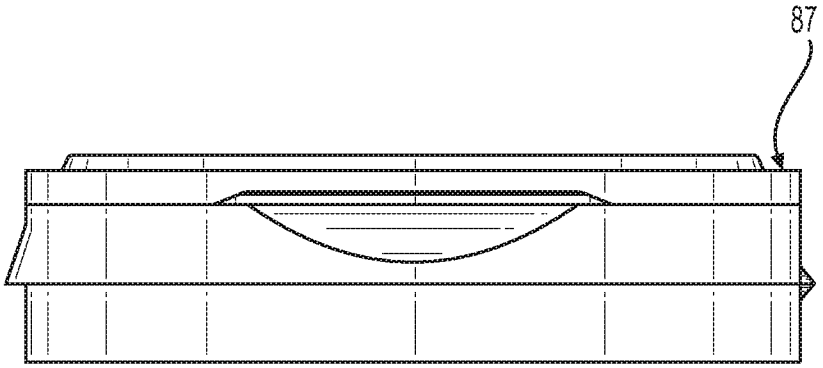
FIG. 35 shows a right side view of FIG. 31.
Figure 36:
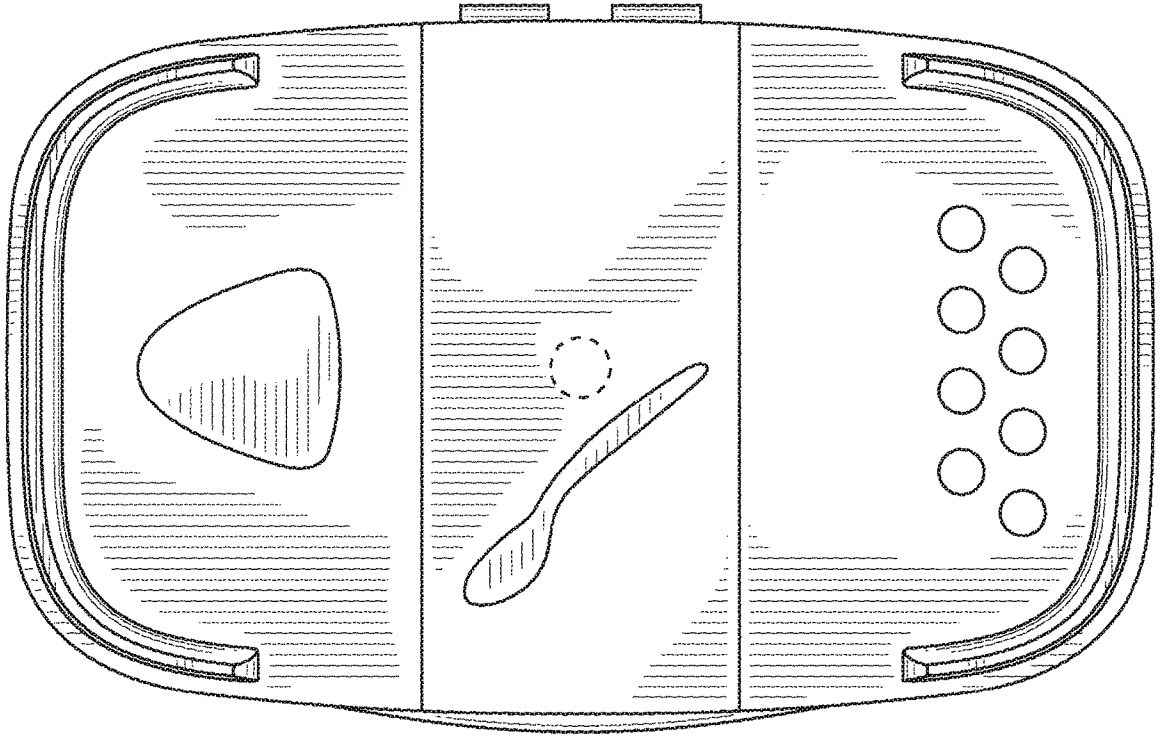
FIG. 36 shows a top view of FIG. 31.
Figure 37:
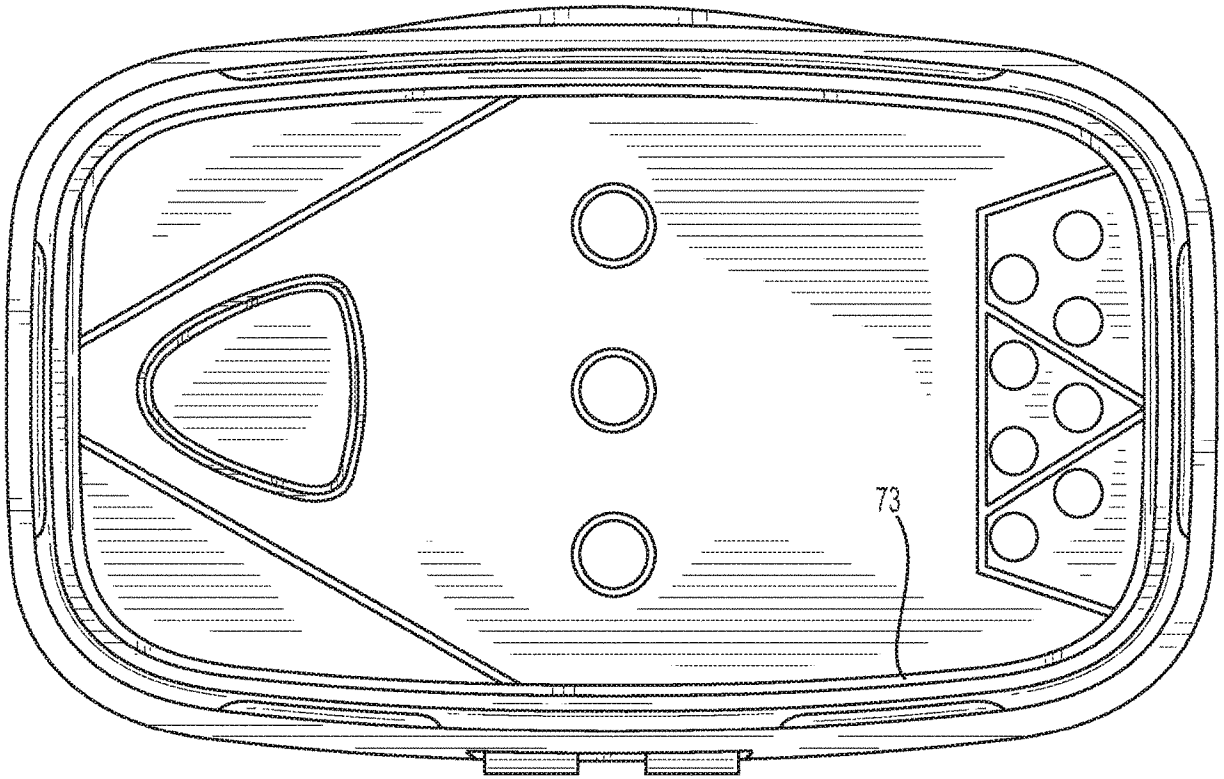
FIG. 37 shows a bottom view of FIG. 31.
Figure 61:
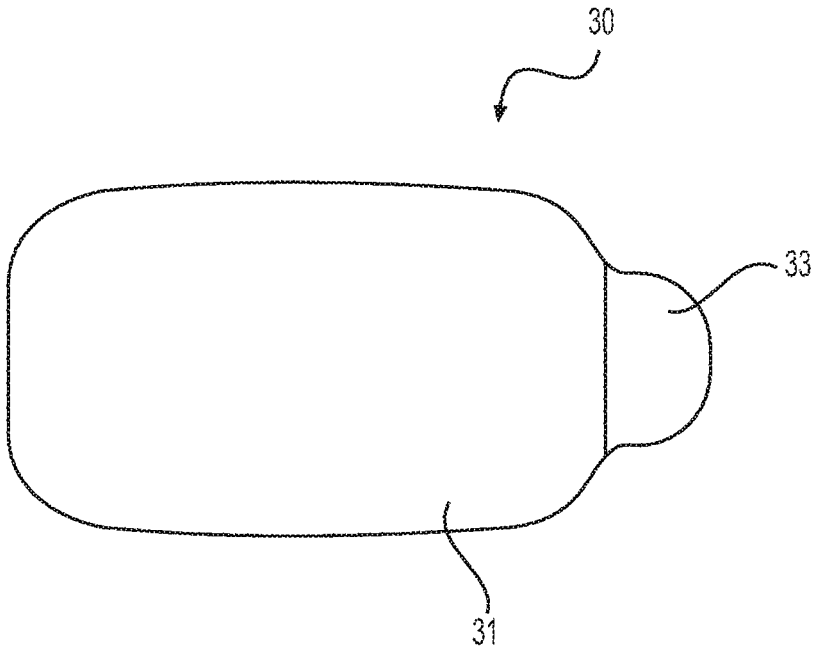
FIG. 61 shows a top view of a tamper-proof seal that can be used to seal the open end of the container shown in FIG. 24.
Figure 62:
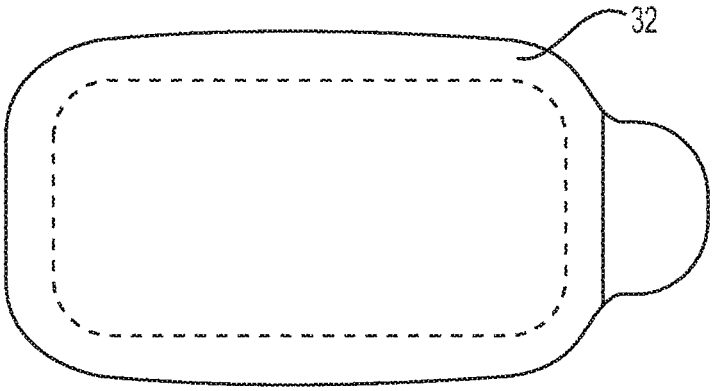
FIG. 62 shows the tamper-proof seal of FIG. 61 but with the peripheral or perimeter attachment zone or area identified. The broken line shape shown in FIG. 62 substantially corresponding to the broken line shape shown in FIG. 24 and represents an inner perimeter of the attachment zone.

FIGS. 1-16 and 24-53 shows a first non-limiting embodiment. As shown in FIG. 1, the embodiment is granulated product container 1000 that includes a generally rectangular container body 10 that can have a volume of between 1 and 32 ounces. FIGS. 17-23 illustrate one way in which a volume of the container can be varied, i.e., by changing an overall length of the container body. As can be seen in FIGS. 1-5 and 24-30, the body 10 has generally outwardly curved, front side 14A and back side 14B. A left generally planar side 14C and a right generally planar side 14D each have a width that is less than the front and back sides. Rounded corners 14E connect the front and back sides to the left and right sides. The body 10 also has a chamfered bottom region 13 (see FIG. 2), a chamfered rim region 18 see FIG. 24) and a lid securing portion 19A-19D located adjacent a rim 16. A removable tamper seal 30 (see FIGS. 61 and 62) can be utilized to seal the opening by attachment to the rim 16. As shown in FIGS. 1 and 31-50, the lid 100 includes a lid base 50 sized and configured to secure the lid 100 to the lid securing portion 19A-19D of the container body 10. A lid or main door assembly 60 is movably mounted and secured to the lid base 50 via a hinge 40. The lid or main door assembly 60 comprises a main door 70 adapted to open on the front side and is hinged 40 on the back side. The main door 70 has a sealing bead 73 that engages with a surface 16 of the rim region in a closed position and that engages, via a snap-connection 78C/58, with the lid base 50 in the closed position. A top plate assembly 80 is mounted to the main door 70.

Figure 51:
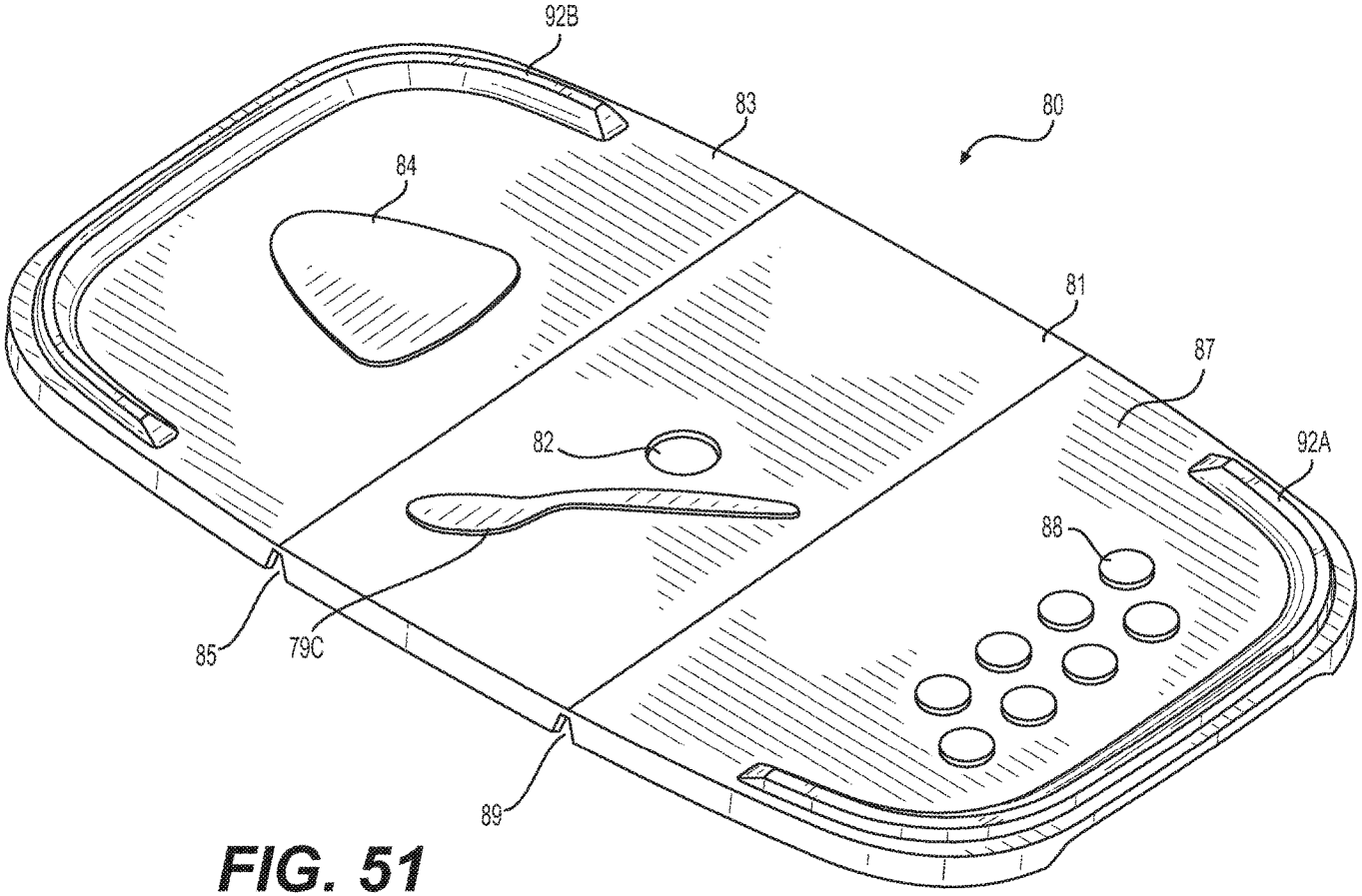
FIG. 51 shows a top perspective view of a top portion utilized on the lid of FIG. 31.

As shown in FIG. 51, the top plate assembly 80 includes a main or central portion 81 that is secured or securable to the door 70. A left side door 83 that can assume at least an open or a closed position via snap-connection with respect to the main door 70 and that closes-off a pour opening 75 arranged on the mam door 70 in the closed position. A right side door 87 that can assume at least an open and a closed position via snap-connection with respect to the main door 70 and that closes-off plural openings 76 arranged on the main door 70 in the closed position. Also included is indicia 84 representative of a pour opening 75, indicia 88 representative of sifting openings 76 and indicia 79C representative of a spoon. In addition, a force required for opening either of the left side door 83 (overcoming plug or snap connection 86/75) or the right side door 87 (overcoming plug or snap connection 90/76) is less than that required to open the main door 70.

Referring to FIGS. 1-7, one can see how the container with three-door lid has a generally rectangular configuration with slightly outwardly curved front and back sides 14A and 14B as well as slightly outwardly curved left and right sides 14C and 14D. Four rounded corners 14E and also utilized on the container body 10 along with a tapered bottom end 13 and a bottom 11 with an indented area 12. As will be described in detail later on, the container 1000 has a three-door lid mounted to the open upper end of the container body 10 and connected (e.g., non-removably or removably mounted) thereto via a snap connection. In embodiments, the container body 10 can be transparent or translucent to allow its contents to be visible. Alternatively, the container body 10 may be a solid color or otherwise opaque so as to at least partially obscure or conceal its contents.

Referring to FIGS. 8-11, one can see how the container with three-door lid can assume an open position to allow for contents to be spooned out. A user or consumer can open the three door lid 100 to assume the position shown in FIG. 8 by pushing up on the projection 78C located on the front of the lid 100 so as to separate door assembly or component 60 from base 50, which remains connected to the top of the container body 10. To open the door assembly 60 from the base 50, one must exert a small force sufficient to overcome the snap connection retaining the same in the closed position. The door assembly 60 includes components 70 and 80 and is movably coupled to the base 50 via a hinge 40. In the open position shown in FIGS. 8-11, one can gain access to the open upper end of the container body 10. Although not shown in FIG. 11, when initially used, the consumer or user will need to remove the seal 30 from the rim 16. The seal 30 can then be discarded. Thereafter, the user or consumer can open the door assembly 60, insert a spoon into the opening 17, and spoon out the container contents. Once this is completed, the user or consumer can close the door assembly 60. This occurs when the user or consumer pushes down on the door assembly 60 until it snap-engages with the base 50, thereby again assuming the closed position shown in FIG. 1.

Referring to FIGS. 12-16, one can see how the container with three-door lid can assume two other open positions to allow for content to be either poured out or sifted out or both. A user or consumer can open the lid door 83 to assume the position shown in FIG. 12 by pushing up on an end of the side lid door 83 so as to separate the sealing projection 84 from the pour opening 75, which acts as a sealing snap connection retain the door 83 in the closed position. To open this door 83 from the member 70, one must exert a small force sufficient to overcome the snap connection retaining the same in the closed position. A user or consumer can also open the other side lid door 87 to assume the position shown in FIG. 12 by pushing up on an end of the lid door 87 so as to separate the sealing projections 90 from respective silting openings 76, which act as sealing snap connections retain the door 87 in the closed position. To open this door 87 from the member 70, one must exert a small force sufficient to overcome the snap connection retaining the same in the closed position. Both doors 83 and 87 are movably coupled to a main element 81 via living hinges 85 and 89. In the open position shown in FIGS. 12-16, one can either pour out the contents via the open door 83 or sift out the same contents via the door 87. Of course, either door 83 or 87 can be opened depending on whether one wishes to pour out the contents or sift out the content. Once either or both (sifting or pouring) are completed, the user or consumer can close the doors 83 and 87. This occurs when the user or consumer pushes down on each door 83 and 87 until it snap-engages with the member 70, with each door 83 and 87 thereby again assuming the closed position shown in FIG. 1. Although sealing engagement between elements 84 and 75 and between elements 90 and 76 can provide a retaining snap engagement for the doors 83 and 87, the snap retaining engagement can be provided by or augmented by additional mechanisms as will described later on.

Referring to FIGS. 24-30, one can see how the container body 10 has an open upper end defined by a main opening 17 and a rim 16. The rim 16, among other things, functions as an attachment area for the seal 30. The upper end of the body 10 includes a mounting configuration for the three door lid 100. This mounting configuration includes the rim 16, a peripheral tapered portion 18, tapered rounded corners 20, and a peripheral indentation 19 that includes snap recesses or indentations 19A, 19B, 19C and 19D.

Figure 38:
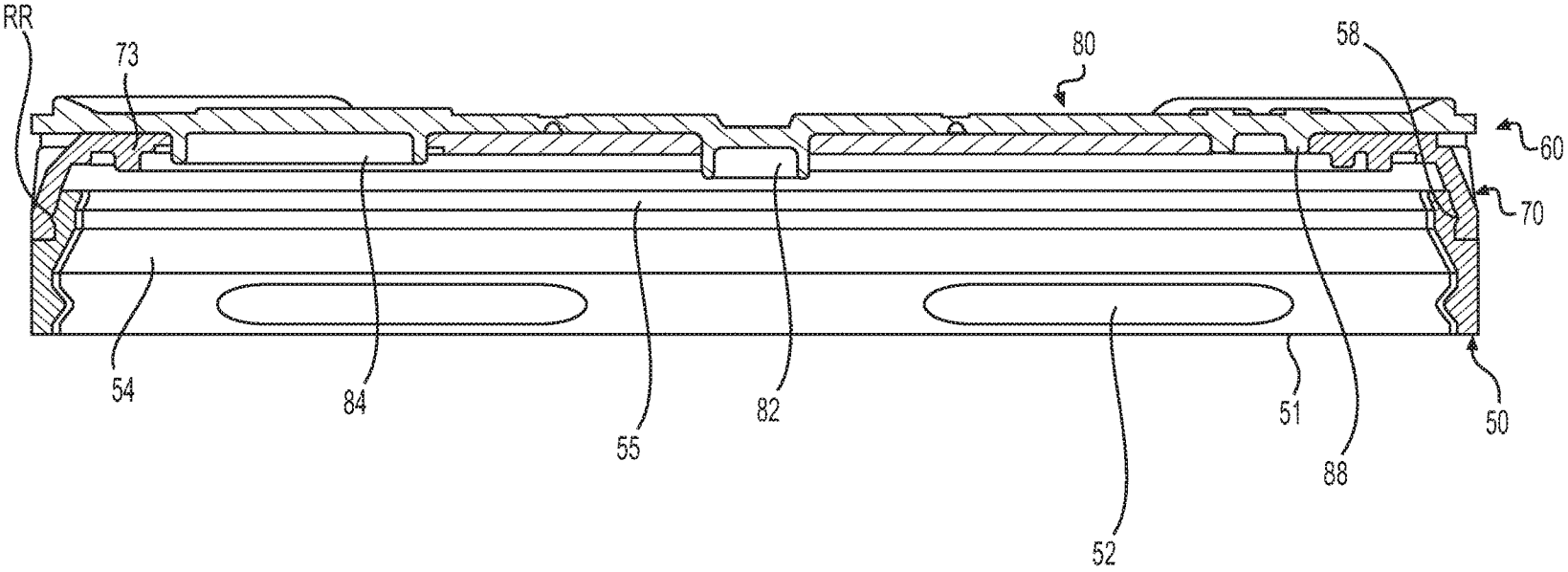
FIG. 38 shows a cross-section of the embodiment of FIG. 31.
Figure 39:
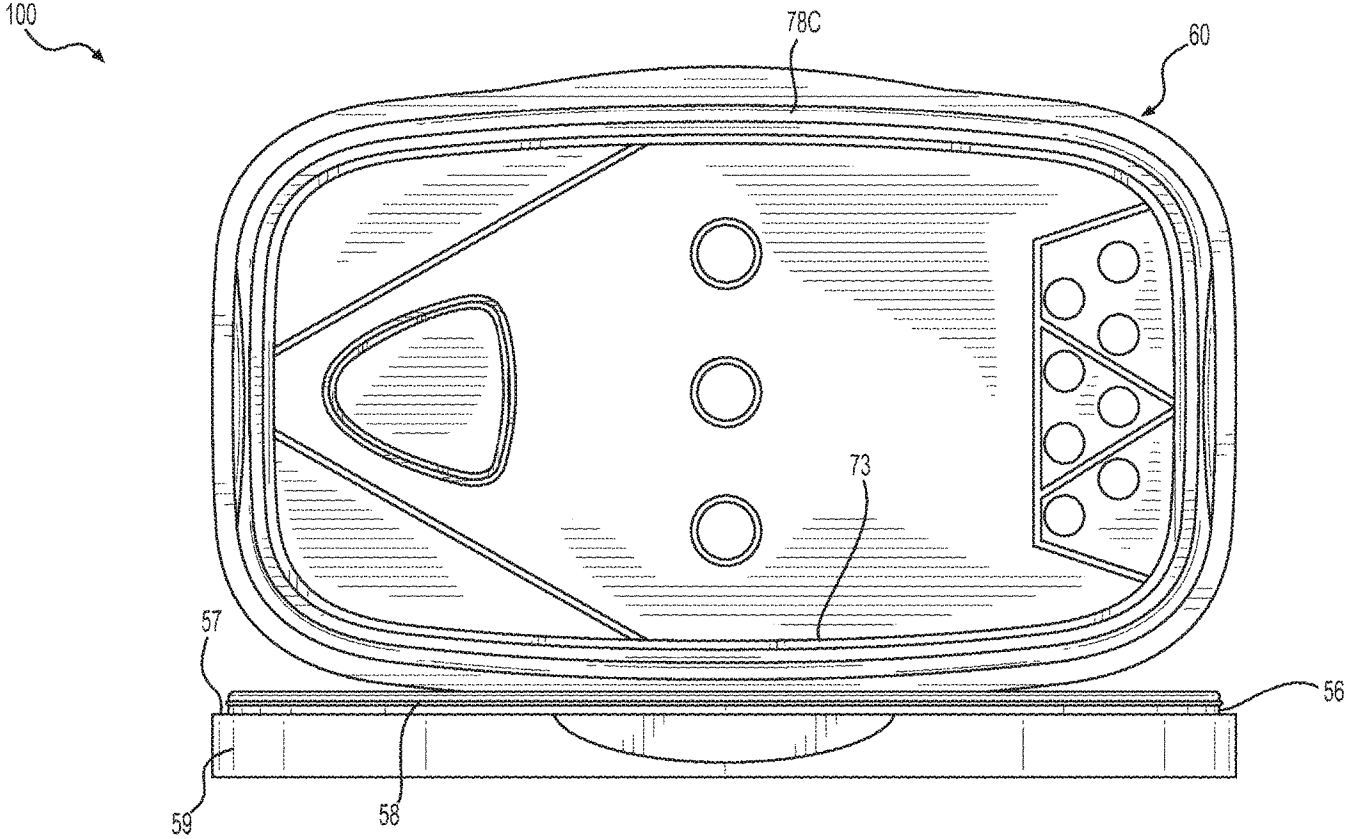
FIG. 39 shows a front view of the three door lid of FIG. 31 with the lid being shown in an open position.
Figure 40:
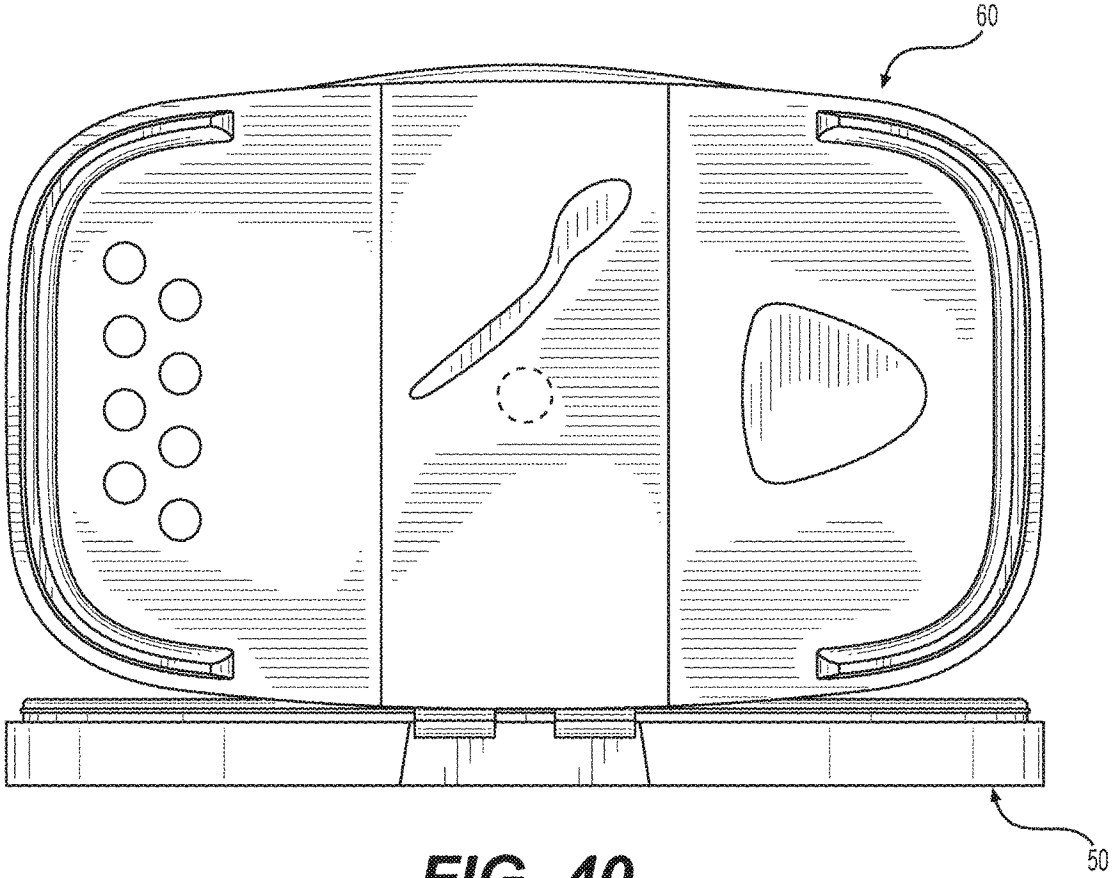
FIG. 40 shows a rear view of FIG. 39.
Figure 41:
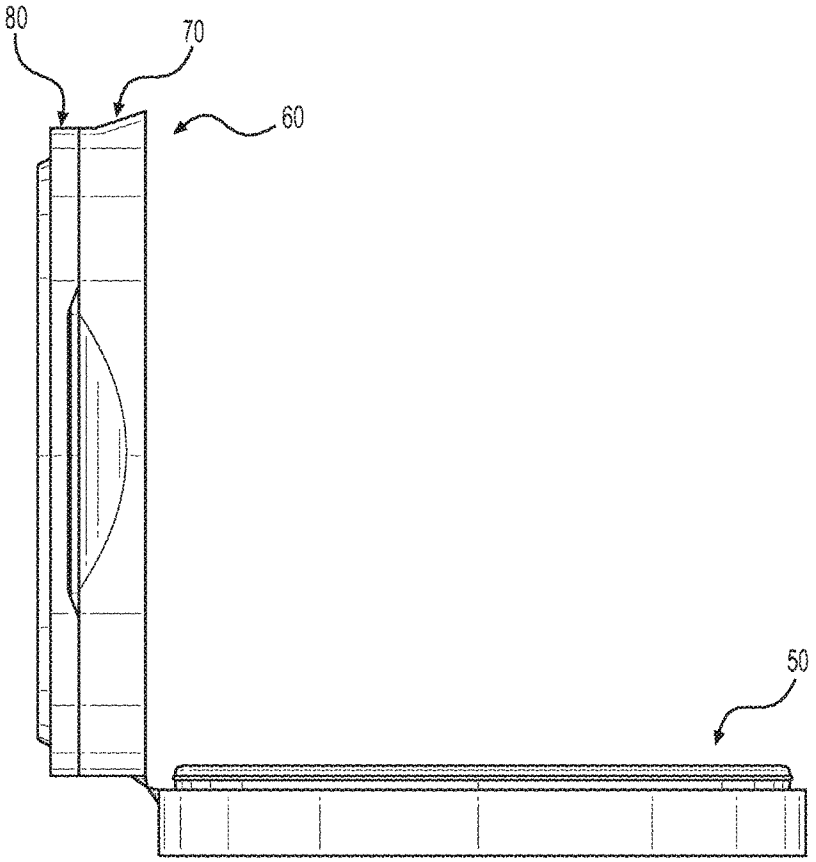
FIG. 41 shows a left side view of FIG. 39.
Figure 42:
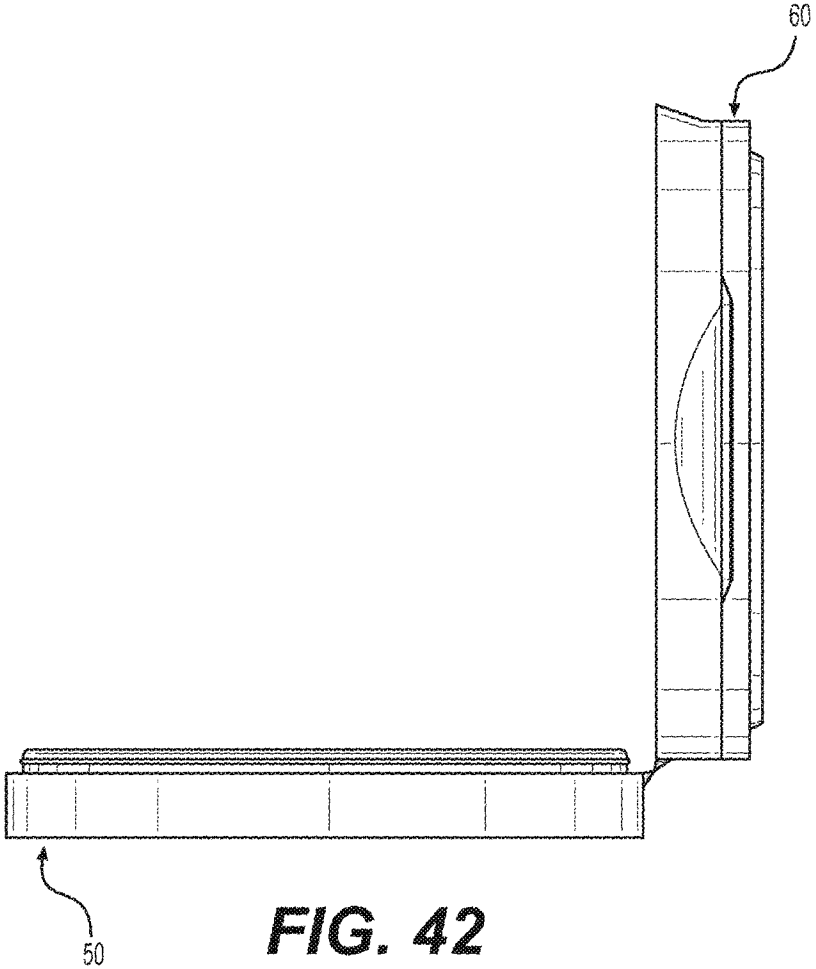
FIG. 42 shows a right side view of FIG. 39.
Figure 43:
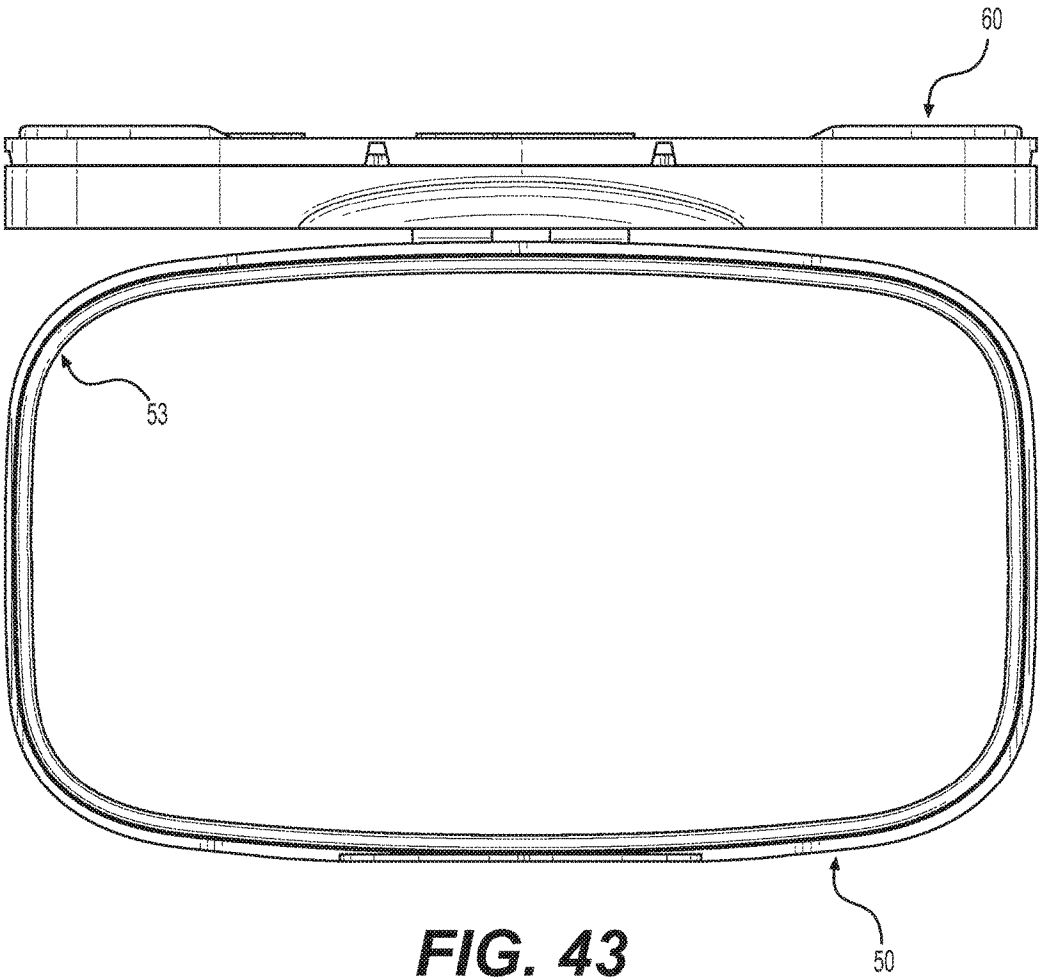
FIG. 43 shows a top view of FIG. 39.
Figure 44:
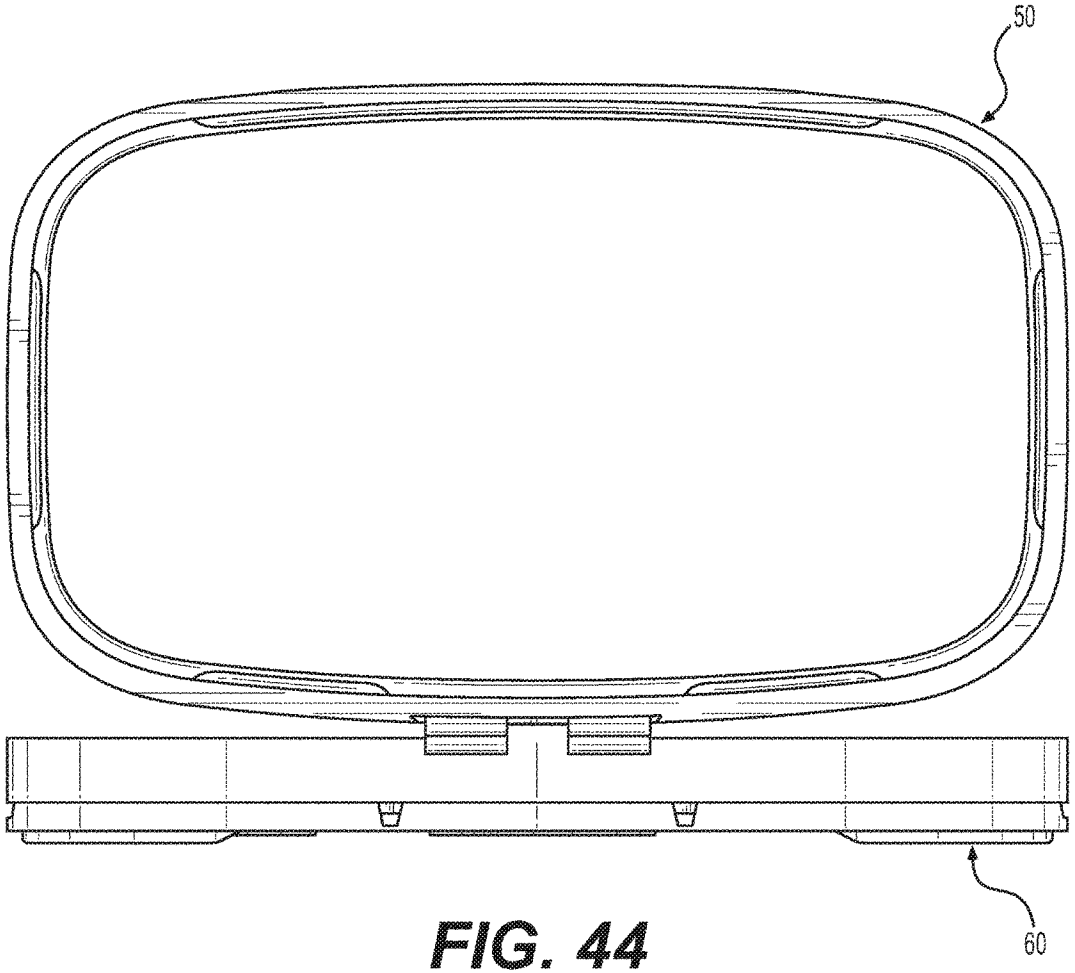
FIG. 44 shows a bottom view of FIG. 39.
Figure 45:
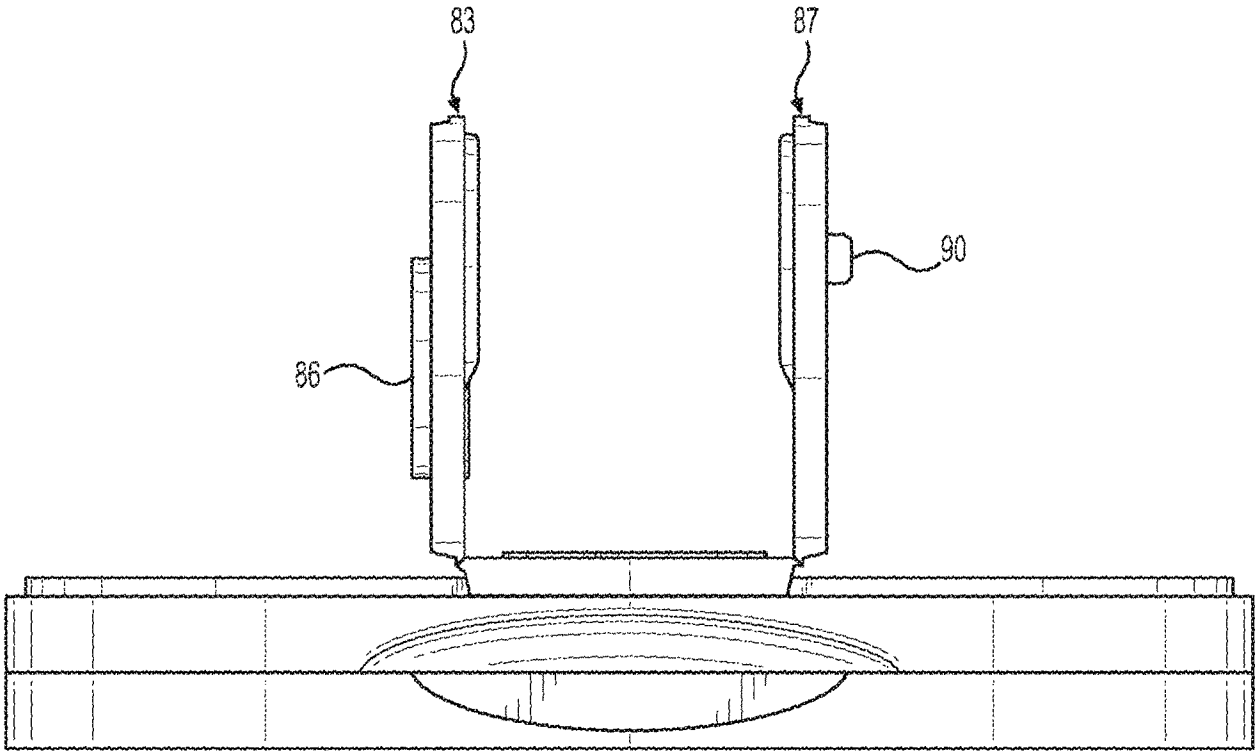
FIG. 45 shows the three door lid of FIG. 31 with the two side doors of the lid being shown in an open position.
Figure 46:
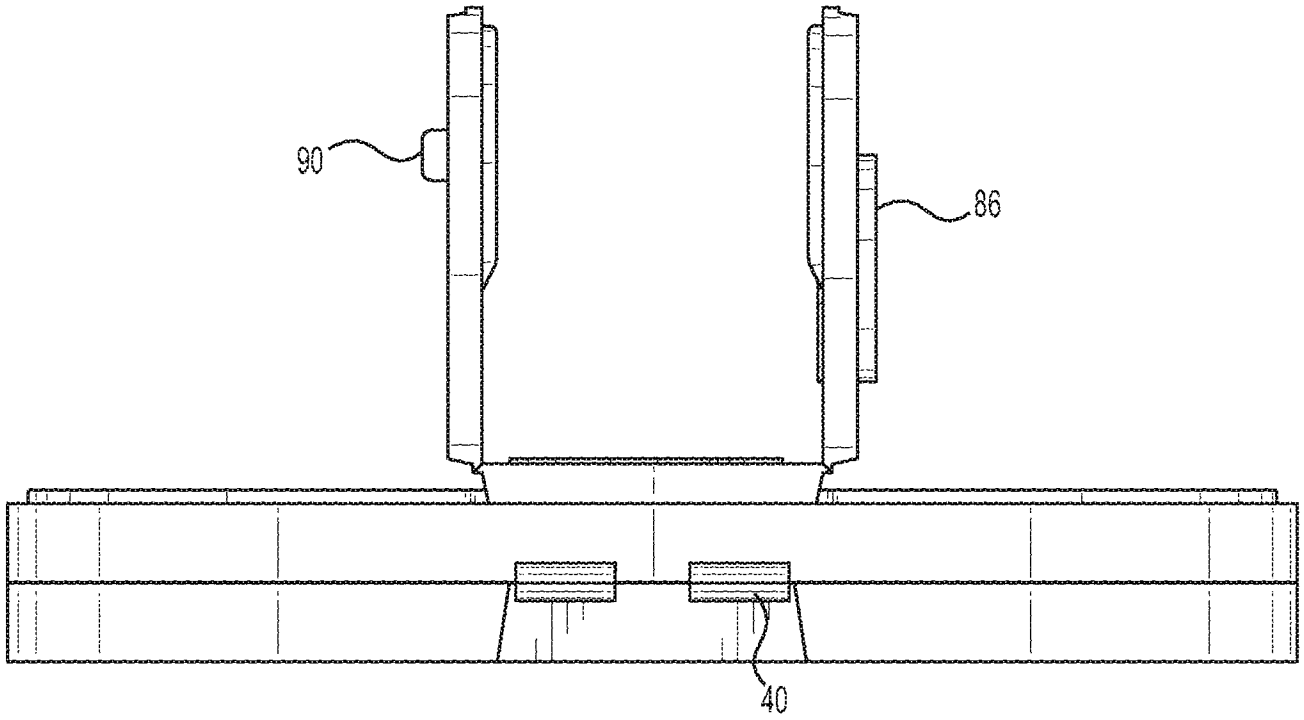
FIG. 46 shows a rear view of FIG. 45.
Figure 47:
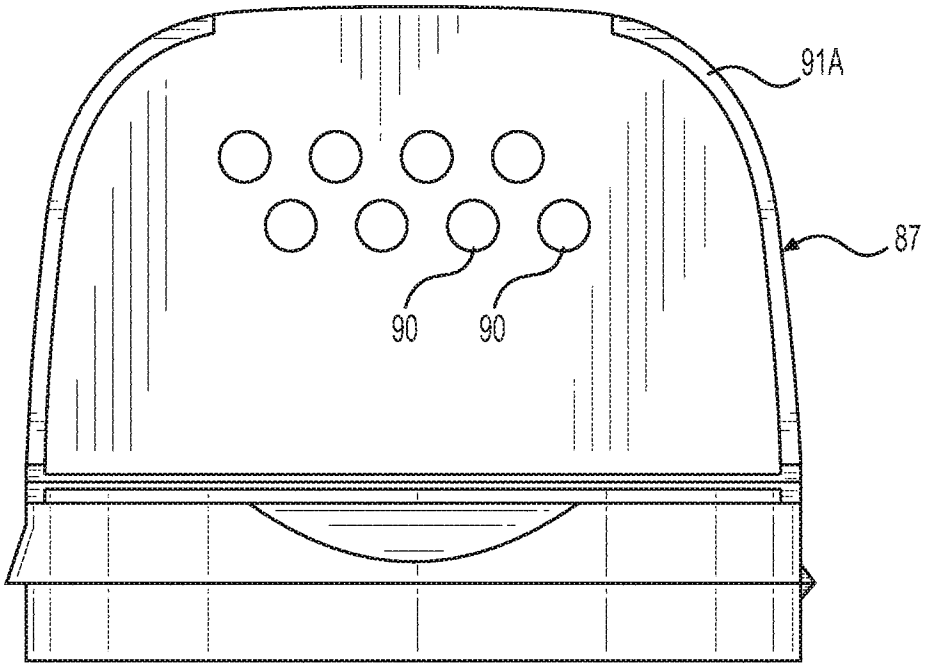
FIG. 47 shows a left view of FIG. 45.
Figure 48:
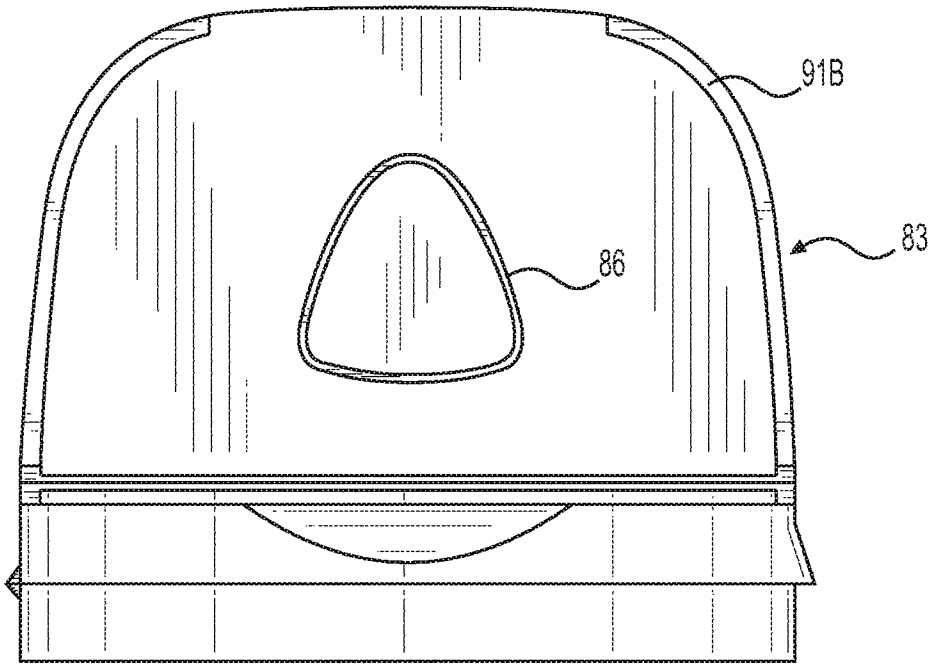
FIG. 48 shows a right side view of FIG. 45.
Figure 49:
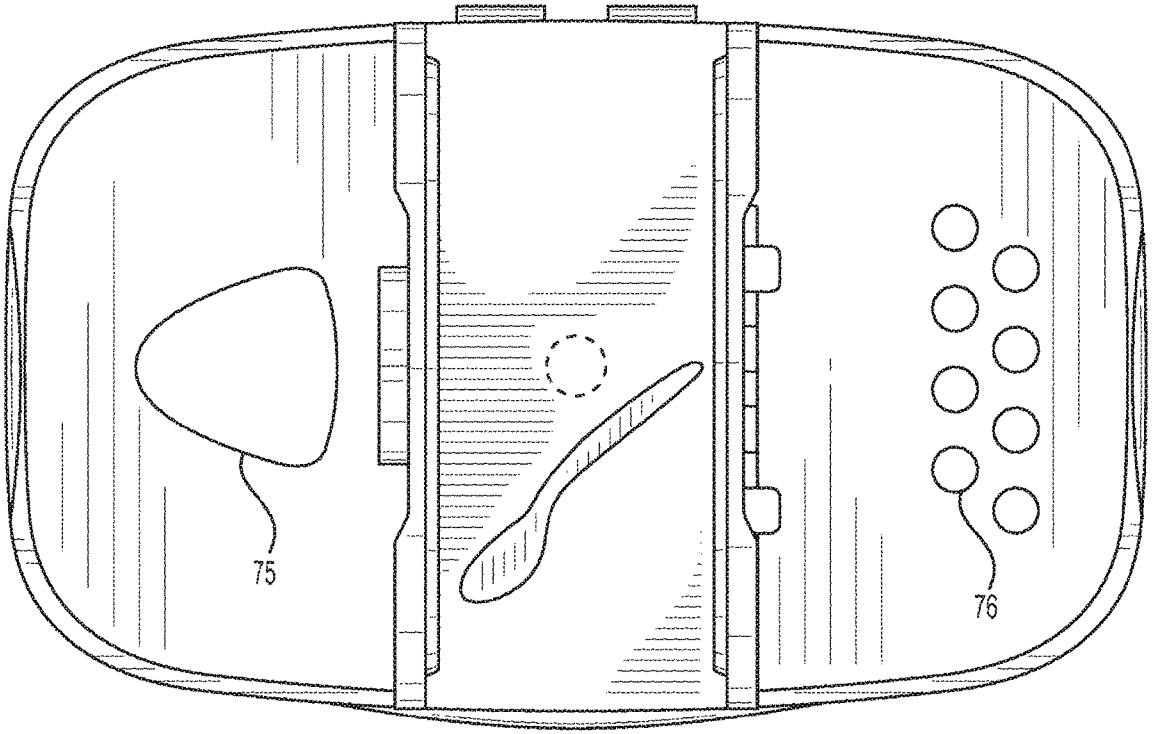
FIG. 49 shows a top side view of FIG. 45.
Figure 50:
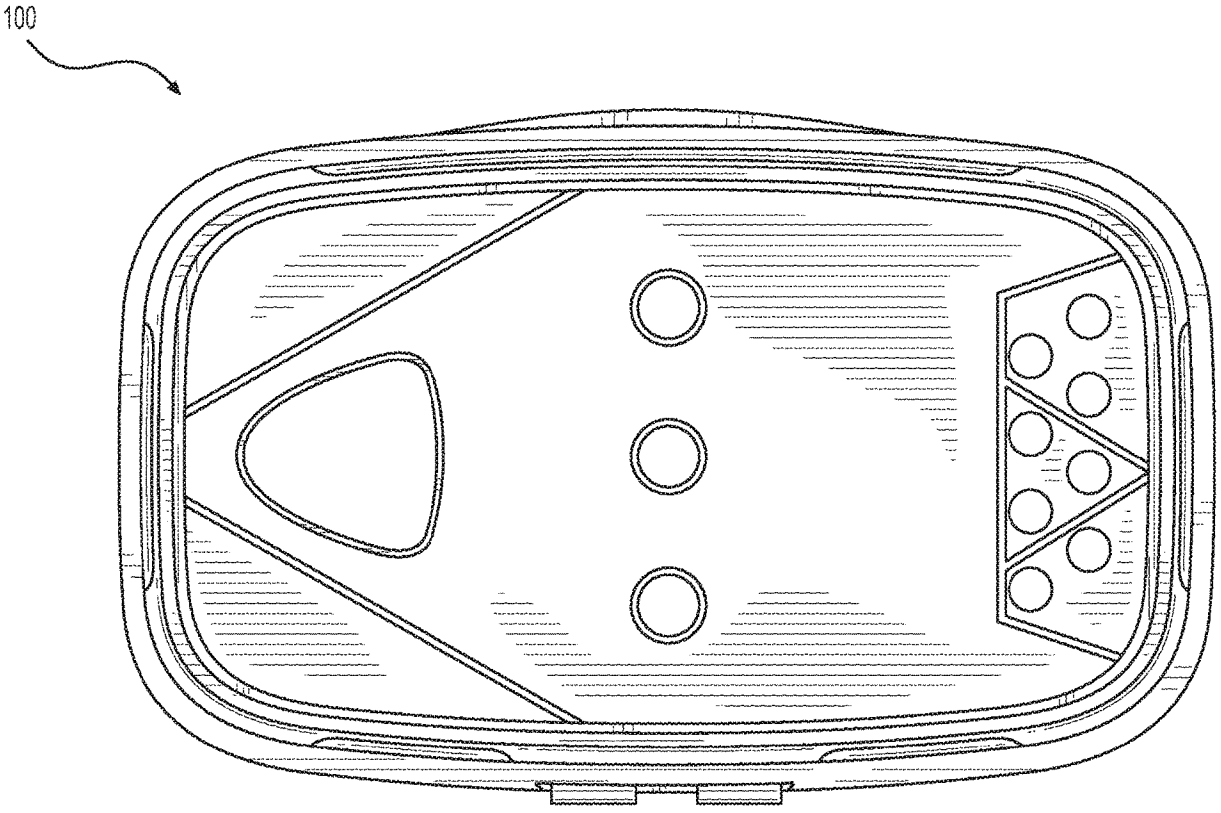
FIG. 50 shows a bottom side view of FIG. 45.

Referring to FIGS. 31-38, one can see how the three-door lid is a separately formed assembly from the container body 10 and includes three main components described above. These include a generally rectangular ring shaped base 50 (see also FIGS. 43 and 44) and the door assembly 60. The base 50 serves to mount to the three-door lid 100 to the container body 10. The door assembly 60 is movably mounted to the base 50 via a hinge 40 which allows the door assembly 60 to move between an open or partially position (see FIG. 39) and a closed position (see FIG. 31). The door assembly 60, in turn, includes a side door plate 80 and a main door 70. The side door plate 80 includes a main portion 81 that is non-removably mounted (via a projection engaging a recess as shown in FIG. 38) to the main door 70, a pouring side door 83 and a silting side door 87. As is apparent from FIG. 38, the base 50 includes a bottom edge 51 as well as a tapered surface 54 that substantially conforms to the tapered surface 18 of the body 10. In addition, the base 50 includes locking or engaging/snap projections 52 which engage with the recesses 19A, 19B, 19C and 19D of the body 10. The base 50 also has an upper end 55 that substantially engages with an upper end of the tapered surface 18, The base 50 also includes a recessed outer perimeter which can be engaged with an inner perimeter of the door 70 as shown in FIG. 38. In the closed position shown in FIG. 38, one can see that the door 70 has a sealing projection 73 that can engage (in a sealing manner) with the rim 16 of the container body 10 (not shown in FIG. 38). As is also apparent from FIG. 38, the side door panel 80 includes one or more seeming projections 82 that engage (via e.g., ultrasonic welding) one or more securing openings as well as a projection 84 that can close off a poor opening of the door 70 and one or more projections 90 that can close off one or more sifting openings in the door 70.

Referring to FIGS. 39-50, one can see how the three-door lid 100 can assume various positions. In FIGS. 39-44, the door assembly 60 is in an open position relative to the base 50. In this position (and when installed on the body 10), the sealing projection 73 would no longer be in contact with the rim 16. In addition, the sealing and engaging projection 58 on the surface 56 is no longer engaged with a retaining recess RR (see FIG. 38). Moreover, the lower end of the door 70 is no longer abutting the shoulder 57 as occurs in the closed position shown in FIG. 38. In FIGS. 45-50, the door assembly 60 is in a closed position relative to the base 50, but the two side doors 83 and 87 are both shown in an open position. Of course, one can also allow door 83 to remain closed while opening only door 87 and vice versa. As should be apparent and as was discussed above, when the door 83 is in the open position, the sealing projection 86 no longer closes off the similarly or identically shaped pour opening 75. As should be apparent and as was discussed above, when the door 87 is in the open position, the sealing projections 90 no longer close off the similarly or identically shaped sifting openings 76. In the exemplary embodiment shown in FIGS. 1-53, two longer projections 90 are combined with shorter projections with the longer projections functioning to help retain the door 87 in a closed position. Of course, other configurations can also be utilized. The door 87 also includes projecting flanges 91A which can function to retain on the door 87 in closed position by being in a snap engagement with a shoulder on the member 70. The door 83 also includes projecting flanges 91B which can function to retain on the door 83 in closed position by being in a snap engagement with a shoulder located above the surfaces 78A and 79B (see FIG. 52) on the member 70.

Figure 52:
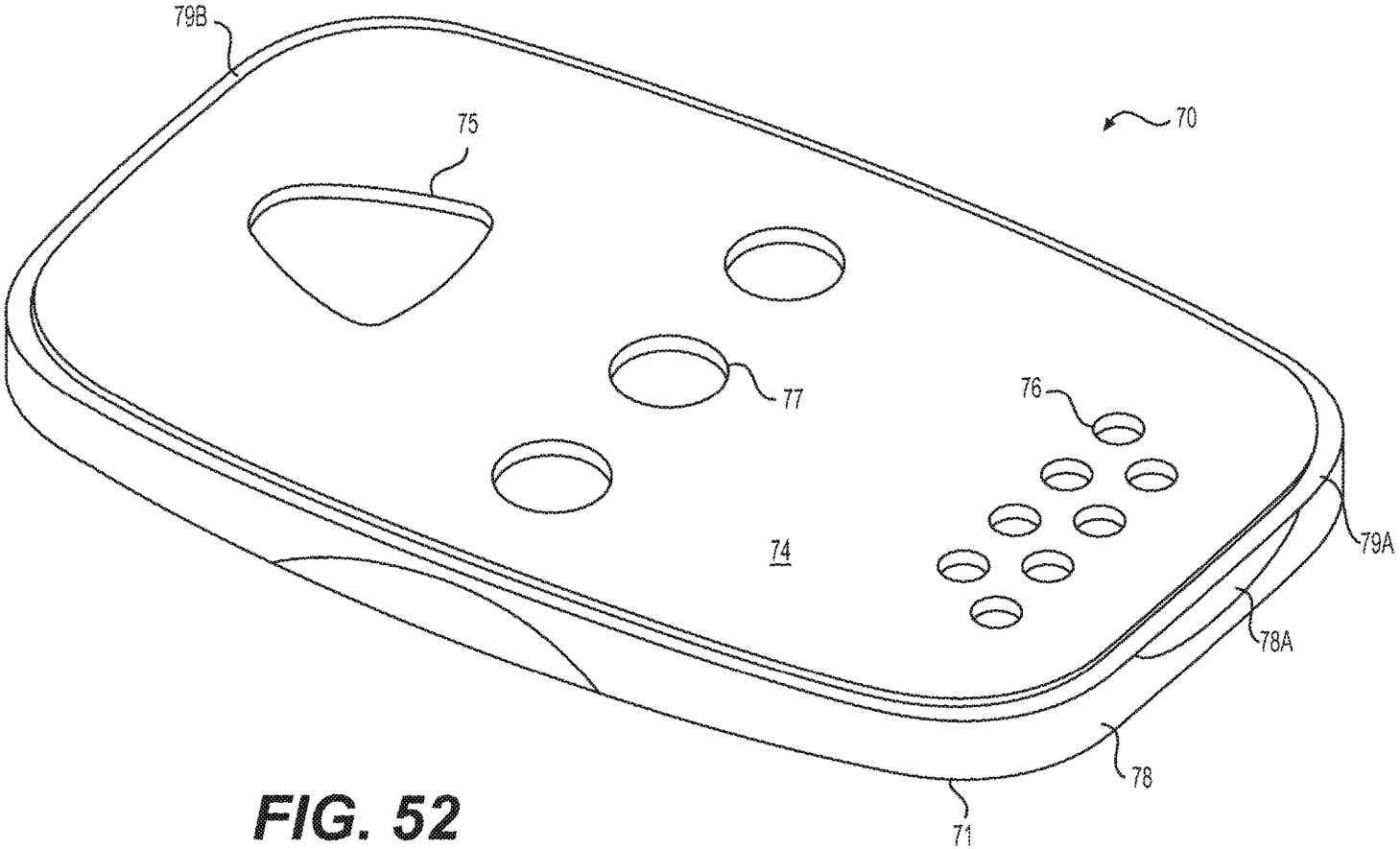
FIG. 52 shows a top perspective view of a middle portion utilized on the lid of FIG. 31.
Figure 53:
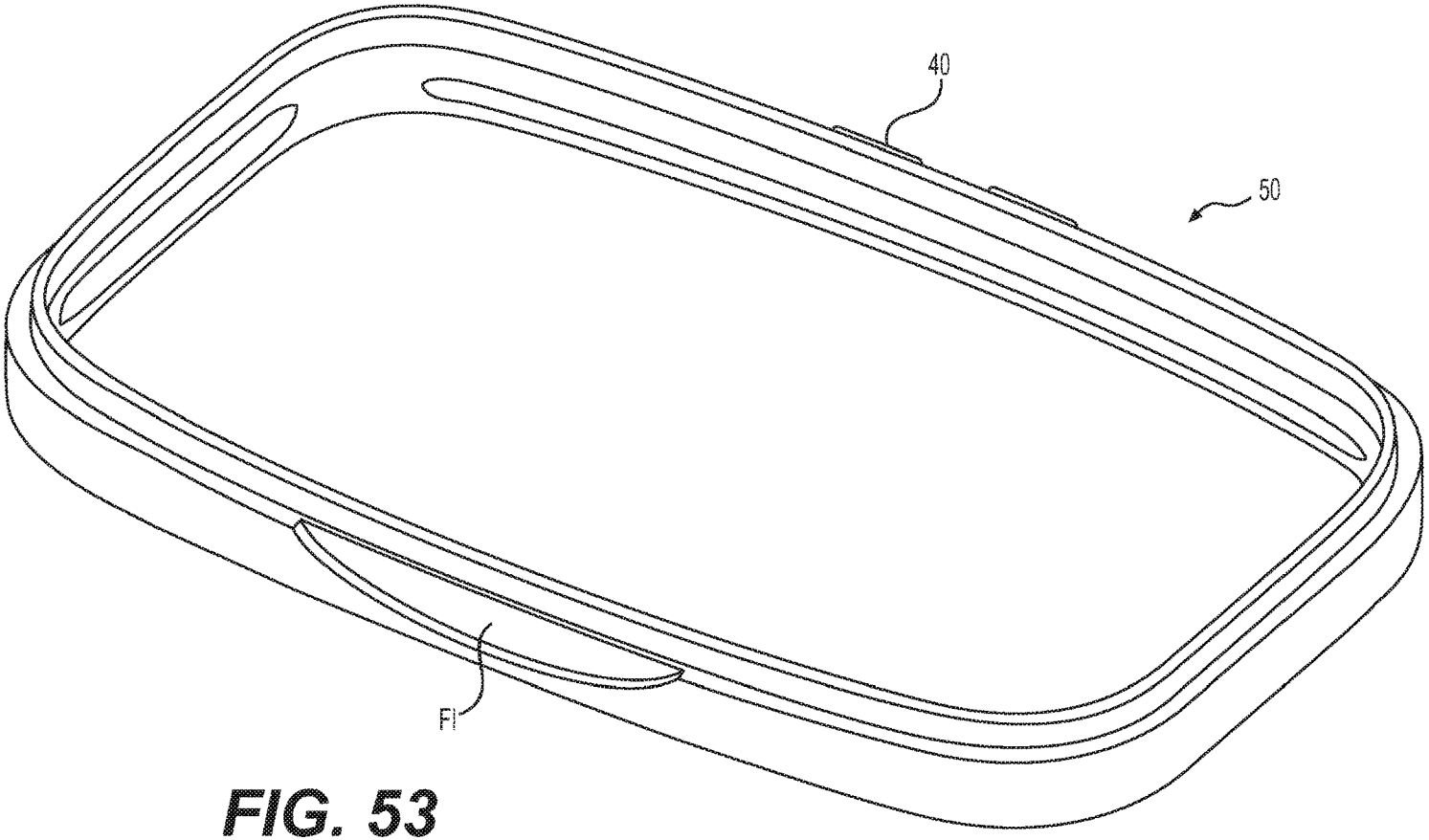
FIG. 53 shows a top perspective view of a bottom portion utilized on the lid of FIG. 31.
Figure 54:
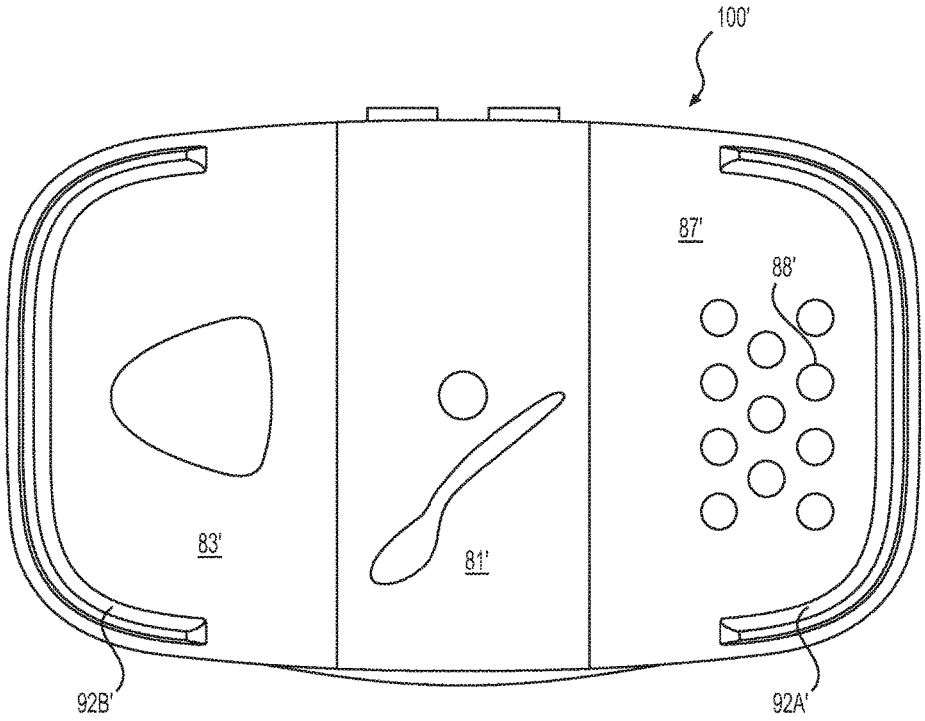
FIG. 54 shows a top view of another embodiment of a three door lid that can be utilized on the container of FIG. 24.
Figure 55:
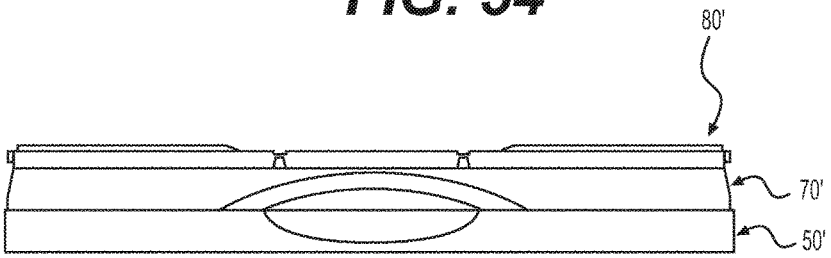
FIG. 55 shows a front view of FIG. 54.

Referring to FIGS. 51-53, one can see the details of the three main components of the three-door lid 100. While these components are assembled and joined together to form the lid 100 prior to being mounted on the container body 10, the top side door plate 80 can be separately formed and then secured to the door assembly formed on components 50 and 70. As should be apparent, the plate 80 can be a one-piece member that includes the main section 81 and two doors 83 and 87 which are connected thereto via living hinges 85 and 89. The door 83 includes a stacking projection 92B and a shaped projection 84 that can slightly project from the upper surface and which provides a visual indication; suggesting both the pour opening location and its shape and size. In this way, a user or consumer is made aware that the door 83 will allow the user to access the pouring feature of the container 1000. The sealing/closing-off projection 86 can be arranged opposite the visual indicator projection 84. Similarly, the door 87 includes a stacking projection 92B and shaped projections 88 that can slightly project from the upper surface and which provides a visual indication; suggesting both the sifting openings location and they number, configuration, shape and size. In this way, a user or consumer is made aware that the door 87 will allow the user to access the sifting feature of the container 1000. The sealing/closing-off projections 90 can be arranged opposite the visual indicator projections 88.

Referring to FIG. 52, one can see the details of the main door 70 which can be formed as a one-piece member with member 50 shown in FIG. 53—with these members being connected via the hinge 40. As is apparent, the member 70 has a generally planar top surface 74 along with a pour opening 75, three securing openings 77 which can serve to mount portion 81, and sifting openings 76. In addition, the two opposite sides utilize an indentation 78A which allows a user to more easily insert a finger and lift open the doors 83 and 87.

Referring to FIG. 53, one can see the details of the base 50 which can be formed as a one-piece member with member 70 shown in FIG. 52—with these members being connected via the hinge 40. As is apparent, the member 50 a generally rectangular ring. In addition, a front side utilized an indentation FI which allows a user to more easily insert a finger and lift open the door assembly 60.

Figure 56:
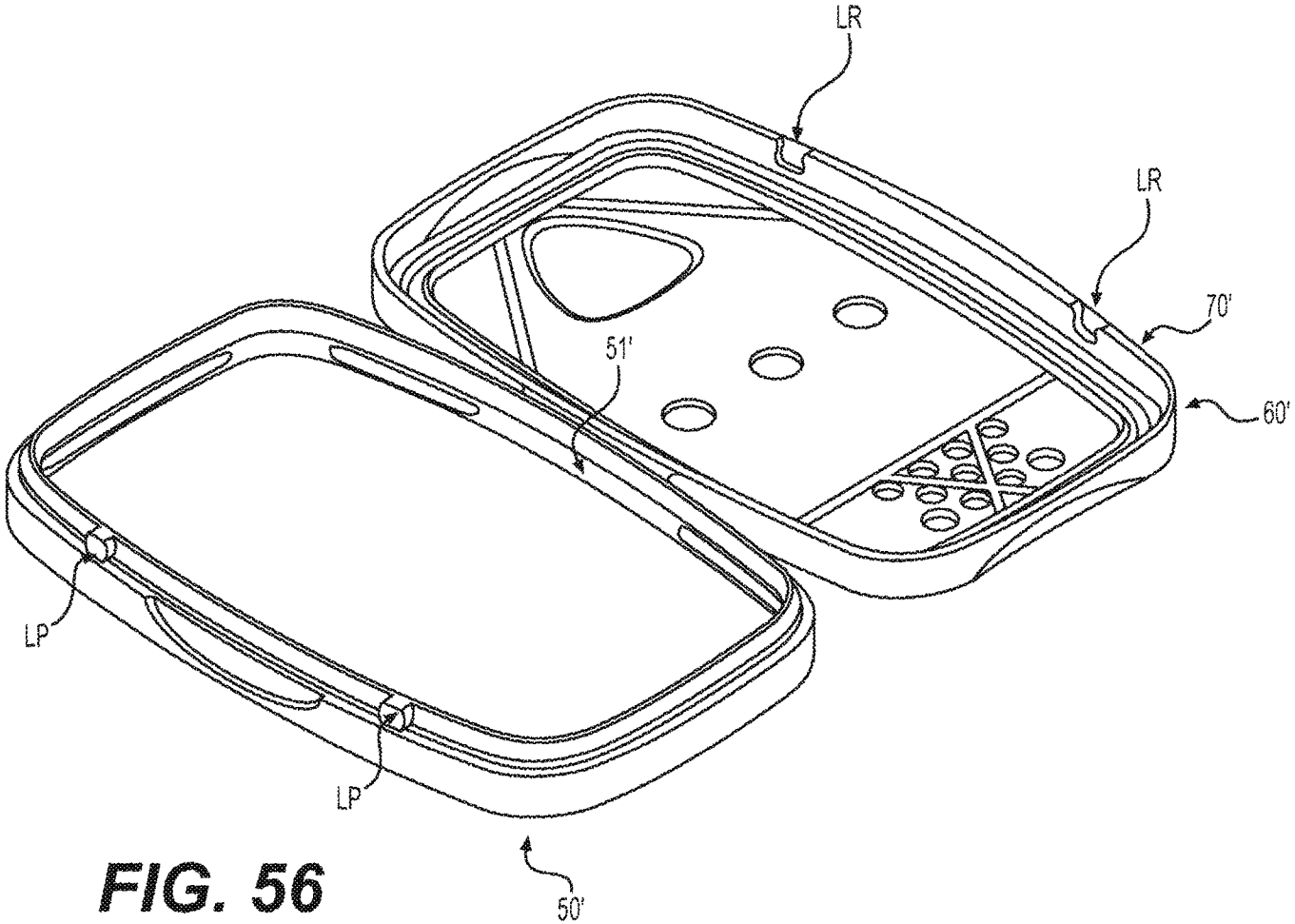
FIG. 56 shows a perspective view of the three door lid of FIG. 54 with the lid being shown in an open position.
Figure 57:
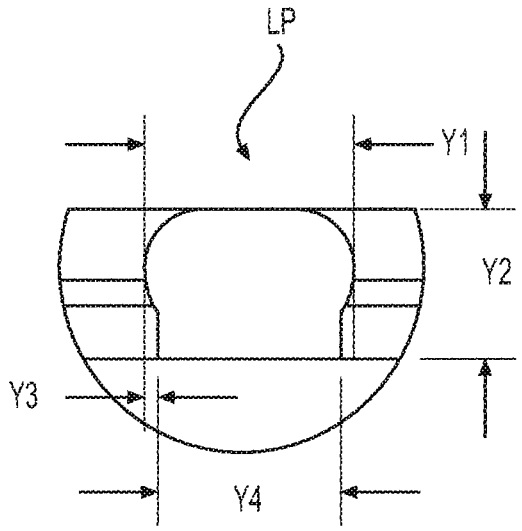
FIG. 57 shows an enlarged portion of a locking/engagement projection of FIG. 56.
Figure 58:
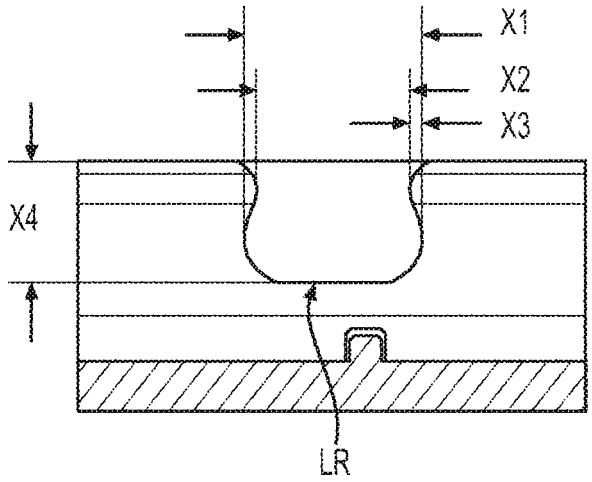
FIG. 58 shows an enlarged portion of a locking/engagement recess of FIG. 56 from the cross-section arrows illustrated in FIG. 59.
Figure 59:
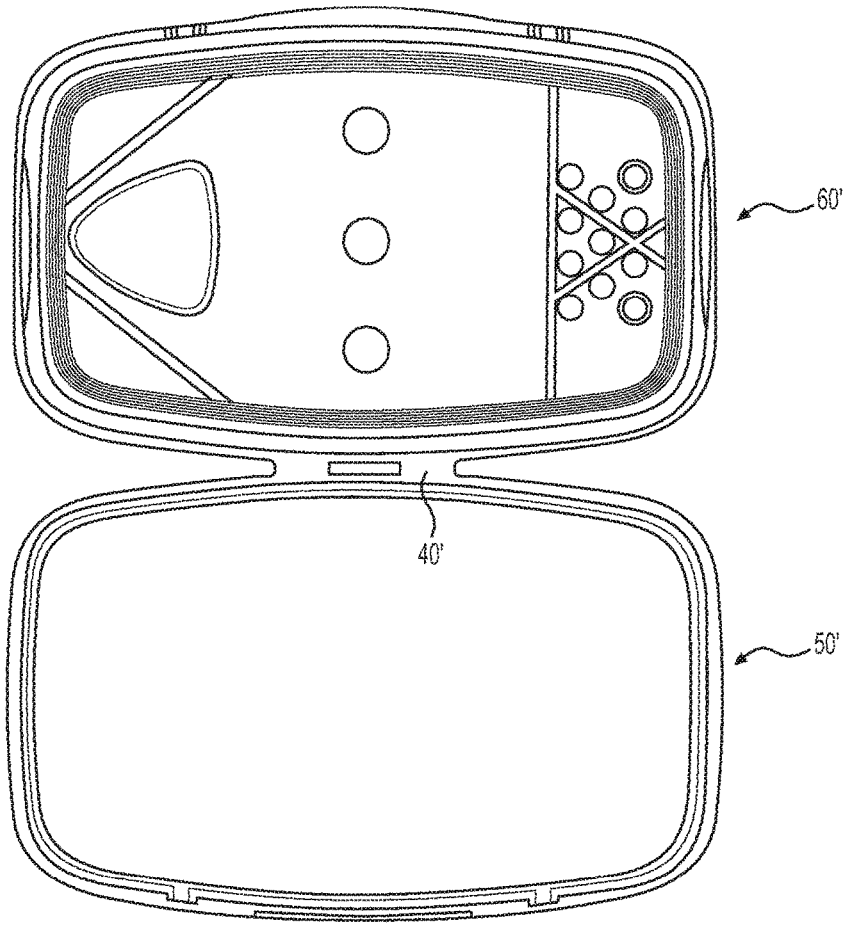
FIG. 59 shows a top view of FIG. 56.
Figure 60:
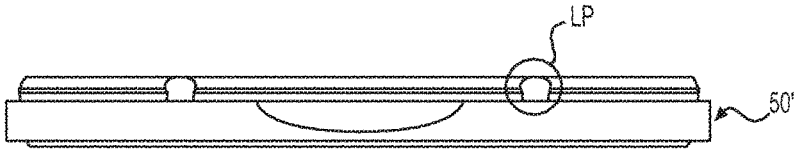
FIG. 60 shows a front view of FIG. 59.

Referring to FIGS. 54-60, one can see how the three-door lid 100' can have a modified configuration. In this embodiment, the lid 100' can include all of the main components and features of the lid 100 except that certain features can be modified and/or added to the same. For example, the lid 100' includes can include different shape and size stacking projections 92B' and 92A'. In addition, the sifting openings located below the visual Indicating projections 88' can be of different number and configuration. Still further, in order to improve the releasable retaining connection between the base 50' and the door assembly 60, one or more locking projections LP can be utilized on the base 50' which are engagable with one or more locking recesses LR arranged on the door 70" of the door assembly 60'. Of course, the projections LP can also be arranged on the door 70' and the recesses JR located on the base 50'. In addition, the projections LP and recesses LR can have other configurations than are shown in FIGS. 56-58. According to one non-limiting embodiment (e.g., a six ounce container), the dimensions of the locking projections may have the following values: X1=0.155 inches, X2=0.135 inches, X3=0.010 inches, X4=0.105 inches and the dimensions of the locking recesses may have the following values: Y1=0.145 inches, Y2=0.100 inches, Y3=0.010 inches or 0.005 inches, Y4=0.125 inches or 0.135 inches. These dimensions can vary depending on how much snap force is desired. In addition, the spacing or location of the projections LP and recesses LR along the side of the rim can vary as well depending on the container volume—with smaller containers, e.g., 3 ounce containers having the projections and recesses located spaced closer to one another or closer to the middle, and with larger volume containers having the projections and recesses located closer to the rim corners or spaced farther from one another on the rim. In addition, in non-limiting embodiments, with the recesses/projections that are spaced closer to one another or located closer to the middle, they (recesses and projections) may have a tapered entrance area, with an angle of about 4.5 degrees. With the recesses spaced farther apart from one another or closer to the corners, they (recesses and projections) may have a slightly greater tapered entrance area with an angle of about 6.337 degrees.

Exemplary features and advantages of the present invention include, in addition to those described herein, a container body with a chamfered bottom, a container body with a chamfered rim area, stacking projections arranged on the sift door and pour door, a generally triangular pour opening that allows for better directional pouring that the pour opening of US 2007/0170192, a peelable tamper seal secured to a rim of the container by welding such as in conduction or induction sealing methods, a tamper seal that is installed prior to installing the lid and that can be removed without requiring removal of the lid from the container, a sealing bead snap connection between the lid base and the container rim that provides a sift-proof seal between these areas, that when the main door is open 90 degrees, one can see an entire rim of the container (see FIG. 10) which allows tor easier spooning out of the container contents, that when the main door is open 90 degrees, a front feeing end (bottom end when closed) of the main door is located or spaced away from the container rim (see FIG. 10) which positions the main door more out of the way and allows for easier spooning out of the container contents, that when the main door is open 90 degrees, one can see an entire rim inner edge of the container (see FIG. 11) which allows for easier spooning out of the container contents, that when the main door is open 180 degrees, one can see an entire rim and rim inner edge of the container (see FIG. 20) which allows for easier spooning out of the container contents, that when the main door is open 180 degrees, an upper facing end (bottom end when closed) of the main door is located below the container rim (see FIG. 20) which positions the main door well out of the way and allows for easier spooning out of the container contents.

The devices described above can also utilize one or more features disclosed in the prior art documents expressly incorporated by reference herein. Furthermore, one or more of the various parts of the device can preferably be made as one-piece structures by e.g., injection molding, when doing so reduces costs of manufacture. Non-limiting materials for all of the parts include synthetic resins such as those approved for food product packaging. The container can, for example, be made of Propylene while the lid can, for example, be made of either PET or PP. Furthermore, the invention also contemplates that any or all disclosed features of one embodiment may be used on other disclosed embodiments, to the extent such modifications function for their intended purpose.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A container, comprising:
- a container body comprising:
  - a bottom;
  - a rim having an integrally formed rim portion that extends toward a center of the container body;
  - said rim portion having an inner edge; and
  - a lid securing portion located adjacent the rim;
- a lid comprising:
  - a lid base sized and configured to secure the lid to the lid securing portion of the container body; and
  - a lid door assembly movably mounted to the lid base, said lid door assembly comprising:
    - a main door that can assume at least a closed position with respect to the lid base and an open position with respect to the lid base, said main door comprising a sealing bead that, when the main door is in the closed position, projects toward the bottom of the container and sealingly engages with said rim portion;
    - a first side door that can assume at least a closed position with respect to the main door and an open position with respect to the main door; and
    - a second side door that can assume at least a closed position with respect to the main door and an open position with respect to the main door,
    - wherein the open position of the main door exposes an entire perimeter of the inner edge of the rim portion whereby contents of the container can be more readily spooned out.

2. The container of claim 1, wherein the container is sized to contain a granular food.

3. The container of claim 1, wherein the main door allows for contents of the container to be spooned out when in the open position and is retained in the closed position by engagement between at least one locking or retaining projection and at least one locking or retaining recess.

4. The container of claim 1, wherein the first door allows for contents of the container to be poured out when in the open position.

5. The container of claim 1, wherein the second door allows for contents of the container to be sifted out when in the open position.

6. The container of claim 1, wherein the main door has a larger cross-sectional area than the rim of the container body.

7. The container of claim 1, wherein the main door has a larger cross-sectional area than either the first door or the second door.

8. The container of claim 1, wherein the main door is connected to the lid base via a hinge.

9. The container of claim 1, wherein the first door overlies and closes a pouring opening formed in the main door when in the closed position.

10. The container of claim 9, wherein the pouring opening is generally triangular.

11. The container of claim 1, wherein the first door comprises a sealing head that engages with a pouring opening formed in the main door when in the closed position.

12. The container of claim 1, wherein the first door comprises a stacking head.

13. The container of claim 1, wherein the first door is mounted via a hinge.

14. The container of claim 1, wherein the second door overlies and closes plural sifting openings formed in the main door when in the closed position.

15. The container of claim 14, wherein the plural sifting openings are generally circular.

16. The container of claim 14, wherein the second door comprises at least one sealing projection that engages with one of the plural sifting openings formed in the main door when in the closed position.

17. A spice container, comprising:
- a container body comprising:
  - a generally rectangular cross-section having a width that is greater than a depth;
  - a generally rectangular bottom;
  - a generally rectangular rim having an integrally formed rim portion that extends toward a center of the container body;
  - a lid securing portion located adjacent the rim; and
  - a height that is greater than the width;
- a generally rectangular lid comprising:
  - a lid base sized and configured to secure the lid to the lid securing portion of the container body, such that when installed, an upper end of the lid base is disposed at or below an upper end of the rim; and
  - a lid door assembly comprising:
    - a main door connected to the lid base via a hinge and that can assume at least a closed position with respect to the lid base and an open position with respect to the lid base, said main door comprising a sealing head that, when the main door is in the closed position, projects toward the bottom of the container and sealingly engages with said rim portion;

a first side door connected to a first hinge and that can assume at least a closed position with respect to the main door and an open position with respect to the main door; and a second side door connected to a second hinge and that can assume at least a closed position with respect to the main door and an open position with respect to the main door.

18. A granulated product container, comprising:

a generally rectangular container body having a volume of between 1 and 32 ounces and comprising:

generally outwardly curved front and back, sides;

left and right generally planar sides each having a width that is less than the front and back sides;

rounded corners connecting the front and back sides to the left and right sides;

a chamfered bottom region;

a chamfered rim region;

a lid securing portion located adjacent the rim region; and an integrally formed rim portion of the rim region extending toward a center of the container body;

a removable tamper seal;

a lid comprising:

a lid base sized and configured to secure the lid to the lid securing portion of the container body; and a lid door assembly movably mounted to the lid base, said lid door assembly comprising:

a main door adapted to open on the front side and being hinged on the back side, said main door having a sealing bead that projects downwards and engages with an upward facing surface of the rim portion in a closed position and said main door being configured to engage via a snap-connection with the lid base in the closed position, said snap connection including at least one locking projection and at least one locking recess;

a left side door that can assume at least a closed position via snap-connection with respect to the main door and that closes-off a pour opening arranged on the main door in the closed position;

a right side door that can assume at least a closed position via snap-connection with respect to the main door and that closes-off plural openings arranged on the main door in the closed position;

indicia representative of a pour opening;

indicia representative of sifting openings; and indicia representative of a spoon.

19. The container of claim 18, wherein a force required for opening either of the left and right side doors is less than that required to open the main door.

* * * * *